US012692790B2

(12) United States Patent
Wang et al.

(10) Patent No.: US 12,692,790 B2
(45) **Date of Patent: *Jul. 28, 2026**

(54) TUNNELING SYSTEM

(71) Applicants: CCTEG TAIYUAN RESEARCH INSTITUTE, Taiyuan (CN); SHANXI TIANDI COAL MINING MACHINERY CO., LTD., Taiyuan (CN)

(72) Inventors: Bukang Wang, Taiyuan (CN); Hong Wang, Taiyuan (CN); Kai Ma, Taiyuan (CN); Dejun Song, Taiyuan (CN); Faquan Li, Taiyuan (CN); Dianwu Wang, Taiyuan (CN); Qiang Ma, Taiyuan (CN); Jianwei Jia, Taiyuan (CN); Mingjiang Song, Taiyuan (CN); Yanhua Qiao, Taiyuan (CN); Ningning Wang, Taiyuan (CN); Gehui Xie, Taiyuan (CN); Feng Liu, Taiyuan (CN); Sen Xu, Taiyuan (CN); Qiang Zhang, Taiyuan (CN); Dong Song, Taiyuan (CN); Qinghe Chen, Taiyuan (CN);
(Continued)

(73) Assignees: CCTEG Taiyuan Research Institute, Taiyuan (CN); Shanxi Tiandi Coal Mining Machinery Co., LTD., Taiyuan (CN)

( * ) Notice: Subject to any disclaimer, the term of this patent is extended or adjusted under 35 U.S.C. 154(b) by 386 days.

This patent is subject to a terminal disclaimer.

(21) Appl. No.: 18/562,438

(22) PCT Filed: May 27, 2022

(86) PCT No.: PCT/CN2022/095786
§ 371 (c)(1),
(2) Date: Nov. 20, 2023

(87) PCT Pub. No.: WO2023/077785
PCT Pub. Date: May 11, 2023

(65) Prior Publication Data
US 2024/0247551 A1 Jul. 25, 2024

(30) Foreign Application Priority Data
Nov. 8, 2021 (CN) ..... 202111314491.3

(51) Int. Cl.
*E21D 9/12* (2006.01)
*E21C 25/06* (2006.01)
(Continued)

(52) U.S. Cl.
CPC ..... *E21D 9/12* (2013.01); *E21C 35/20* (2013.01); *E21D 9/10* (2013.01); *E21D 20/003* (2013.01); *E21D 23/04* (2013.01); *E21C 25/06* (2013.01)

(58) Field of Classification Search
CPC ..... E21D 9/12; E21D 9/10; E21D 20/003; E21D 23/04; E21C 35/20; E21C 25/06
See application file for complete search history.

(56) References Cited

U.S. PATENT DOCUMENTS 4,957,405 A * 9/1990 Roberts ..... B65G 41/02 198/594
5,050,934 A * 9/1991 Brandl ..... E21D 20/003 299/33
(Continued)

FOREIGN PATENT DOCUMENTS

AU 2012283438 A1 3/2014
CN 104564050 A 4/2015
(Continued)

OTHER PUBLICATIONS

Office Action for corresponding AU application No. 2022381877, mailed Jan. 28, 2025 (6 pages).
(Continued)

*Primary Examiner* — Janine M Kreck
(74) *Attorney, Agent, or Firm* — Maginot, Moore & Beck, LLP

(57) ABSTRACT

A tunneling system includes a bolter miner, a bolter-integrated transportation machine, a transfer machine, a self-
(Continued)

moving tail and a belt conveyor. The bolter miner includes a rack, a cutting device, and a bolt support device. The bolt support device includes a lifting assembly, a work platform, a first drilling frame assembly and a stabilizing assembly. The lifting assembly is arranged between the rack and the work platform. The first drilling frame assembly and the stabilizing assembly are arranged on the work platform. The bolter-integrated transportation machine is arranged behind the bolter miner and configured to transfer coal rock cut and conveyed by the bolter miner. One end of the transfer machine is connected with the bolter-integrated transportation machine, and the other end of the transfer machine is lapped with the self-moving tail. The belt conveyor is arranged behind the self-moving tail.

20 Claims, 16 Drawing Sheets

(72) Inventors: Xuerui Zhang, Taiyuan (CN); Jinbao Yan, Taiyuan (CN); Xipeng Wang, Taiyuan (CN); Xiaoli Ren, Taiyuan (CN); Yuhua Ma, Taiyuan (CN); Yuanyuan Zhao, Taiyuan (CN); Mingjun Chen, Taiyuan (CN); Shengyuan Sang, Taiyuan (CN); Weijian Qiu, Taiyuan (CN); Wenwu Liu, Taiyuan (CN)

(51) Int. Cl.

| | |
|---|---|
| ***E21C 35/20*** | (2006.01) |
| ***E21D 9/10*** | (2006.01) |
| ***E21D 20/00*** | (2006.01) |
| ***E21D 23/04*** | (2006.01) |

(56) References Cited

U.S. PATENT DOCUMENTS

| | | | | |
|---|---|---|---|---|
| 5,246,274 | A * | 9/1993 | Smith | E21C 27/24 299/30 |
| 2005/0129466 | A1 | 6/2005 | Walker et al. | |

FOREIGN PATENT DOCUMENTS

| | | | |
|---|---|---|---|
| CN | 105971599 | A | 9/2016 |
| CN | 112065424 | A | 12/2020 |
| CN | 112855203 | A | 5/2021 |
| CN | 113187474 | A | 7/2021 |
| CN | 113202466 | A | 8/2021 |
| CN | 113202525 | A | 8/2021 |
| CN | 114017019 | A | 2/2022 |
| CN | 114017020 | A | 2/2022 |
| CN | 114017021 | A | 2/2022 |
| CN | 114017022 | A | 2/2022 |
| CN | 114033414 | A | 2/2022 |
| CN | 114109423 | A | 3/2022 |
| CN | 114109425 | A | 3/2022 |

OTHER PUBLICATIONS

International Search Report corresponding to PCT Application No. PCT/CN2022/095786, mailed Aug. 11, 2022 (Chinese and English language document) (7 pages).
OA for CN application 202111314491.3.
English translation of OA for CN application 202111314491.3.

* cited by examiner

TUNNELING SYSTEM

CROSS-REFERENCE TO RELATED APPLICATIONS

The present application is a national phase entry under 35 USC § 371 of International Application No. PCT/CN2022/095786, filed on May 27, 2022, which claims the benefit of and priority to Chinese Application No. 202111314491.3, filed on Nov. 8, 2021, the entire disclosures of which are incorporated herein by reference.

FIELD

The present disclosure relates to a field of tunnel tunneling, and more particularly to a tunneling system.

BACKGROUND

A tunneling system is one of six major systems in a coal mine, and the tunneling system is mainly used for tunneling and bolt support construction of underground tunnels. The tunneling system includes apparatuses such as a heading machine, a transfer machine, a belt conveyor, and so on. The heading machine cuts a coal wall at a heading face, and coal rock generated by the cutting needs to be conveyed to the ground through the subsequent transfer machine and belt conveyor, so as to complete the tunneling of the tunnel. In the related art, during tunneling, the tunneling system has the risk of caving and a large amplitude of bending and sinking at the heading face, which is not conducive to the safe production of the mine.

SUMMARY

Embodiments of the present disclosure provide a tunneling system, and the tunneling system includes: a bolter miner including a rack, a cutting device, and a bolt support device, wherein the cutting device is arranged on the rack and swingable in an up-down direction, the bolt support device includes a lifting assembly, a work platform, a first drilling frame assembly and a stabilizing assembly, the lifting assembly is arranged between the rack and the work platform, the lifting assembly is configured to lift the work platform, the first drilling frame assembly and the stabilizing assembly are arranged on the work platform, the work platform is retractable to allow the first drilling frame assembly to move to be above the cutting device, the first drilling frame assembly is configured to perform a bolt support operation, and the stabilizing assembly is configured to be supported between the cutting device and a tunnel roof to enhance the stability of the first drilling frame assembly during the bolt support operation; a bolter-integrated transportation machine arranged behind the bolter miner and configured to transfer coal rock cut and conveyed by the bolter miner; a transfer machine and a self-moving tail, wherein one end of the transfer machine is connected with the bolter-integrated transportation machine and is configured to move synchronously with the bolter-integrated transportation machine, the transfer machine is bendable, the transfer machine is arranged behind the bolter-integrated transportation machine, the transfer machine is configured to transfer the coal rock conveyed by the bolter-integrated transportation machine, the other end of the transfer machine is lapped with the self-moving tail, and the self-moving tail is configured to transfer the coal rock conveyed by the transfer machine; and a belt conveyor arranged behind the self-moving tail, and configured to transfer the coal rock conveyed by the self-moving tail.

DETAILED DESCRIPTION

Figure 1:
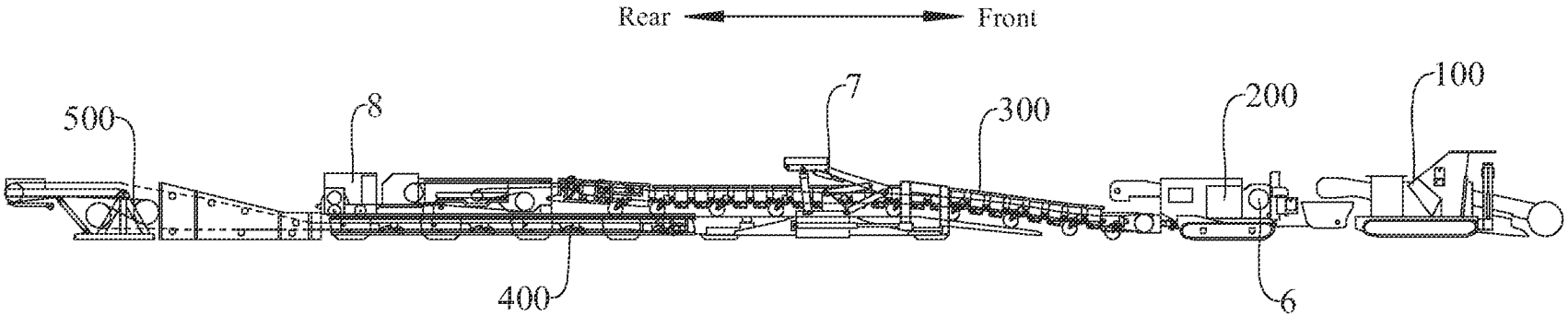
FIG. 1 is a side view of a tunneling system according to an embodiment of the present disclosure.

Reference will be made in detail to embodiments of the present disclosure, and examples of the embodiments are shown in the accompanying drawings. The embodiments described herein with reference to the drawings are illustrative, and are intended to explain the present disclosure, but shall not be construed to limit the present disclosure.

As shown in FIGS. 1-24, according to an embodiment of the present disclosure, a tunneling system includes a bolter miner 100, a bolter-integrated transportation machine 200, a transfer machine 300, a self-moving tail 400 and a belt conveyor 500.

Figure 5:
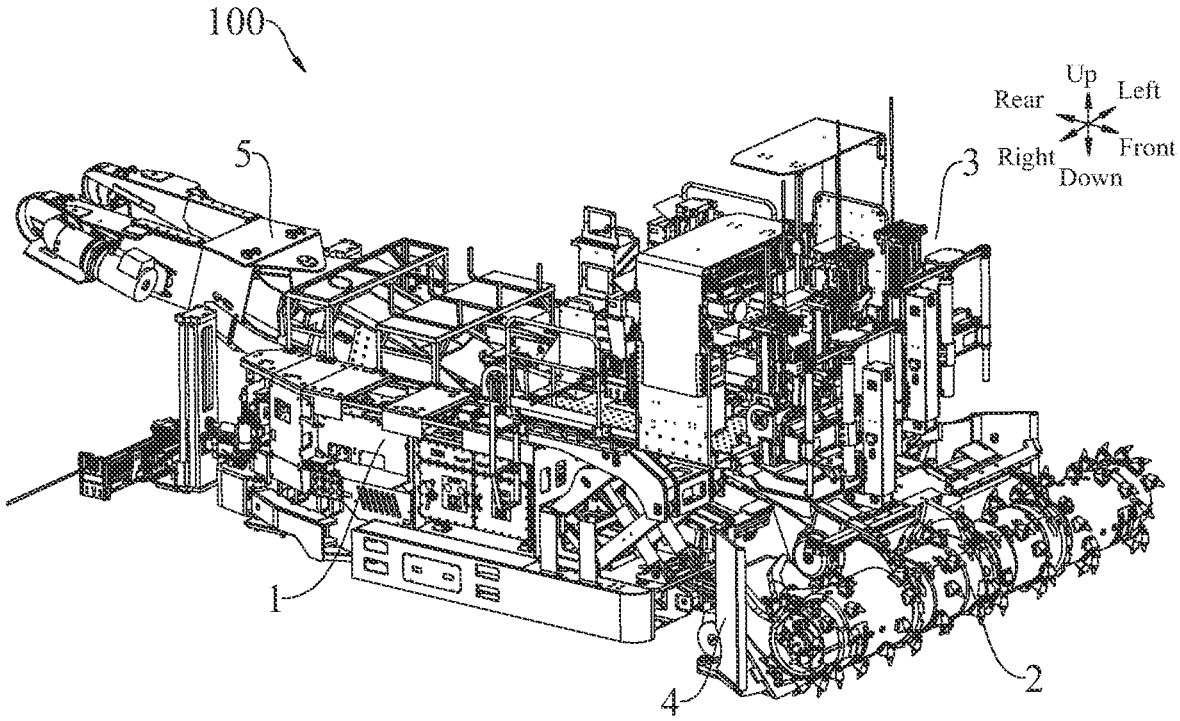
FIG. 5 is a perspective view of an overall structure of a bolter miner in FIG. 1.

The bolter miner 100 may be arranged at a frontmost end of the tunneling system, and the bolter miner 100 includes a rack 1, a cutting device 2, and a bolt support device 3. As shown in FIG. 5, the rack 1 may be regarded as a body frame of the bolter miner 100, and the bolter miner 100 may further include a walking device, a shovel plate device 4, a conveying trough device 5, etc. The walking device, the cutting device 2, the shovel plate device 4 and the conveying trough device 5 are all assembled on the rack 1.

It should be noted that, both the cutting device 2 and the shovel plate device 4 are arranged at a front end of the rack 1. The cutting device 2 includes a cutting drum 21, and the shovel plate device 4 is located below the cutting drum 21. The conveying trough device 5 extends along a length direction (i.e., a front-rear direction) of the rack 1. Coal rock cut by the cutting drum 21 may be gathered by the shovel plate device 4 and conveyed to a front inlet of the conveying trough device 5, and then the coal rock may be conveyed backwards by the conveying trough device 5.

The walking device may be a crawler-type walking device, and may be mounted below the rack 1. Automatic movement of the bolter miner 100 can be achieved by the walking device.

Figure 6:
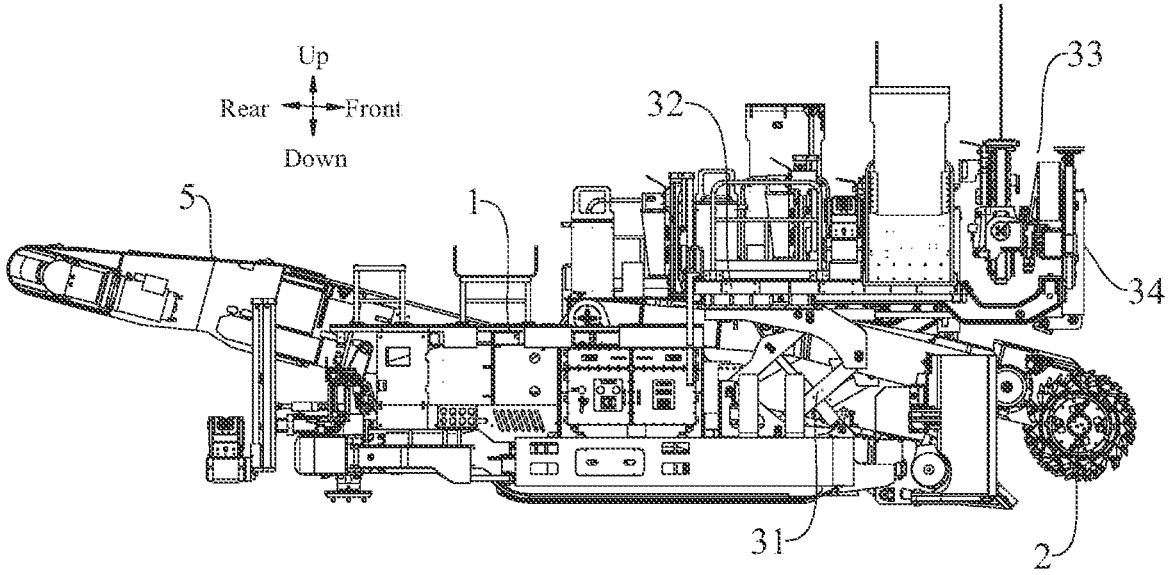
FIG. 6 is a right view of the bolter miner in FIG. 5.

The cutting device 2 is arranged on the rack 1 and is swingable in an up-down direction. The cutting device 2 is suitable for cutting operations. Specifically, as shown in FIG. 5 and FIG. 6, the cutting device 2 includes a cutting arm and the cutting drum 21. The cutting arm generally extends along the front-rear direction, and a rear end of the cutting arm is connected with the rack 1 and is swingable in the up-down direction relative to the rack 1. The cutting drum 21 is assembled at a front end of the cutting arm. When in use, cutting operations on a front coal wall can be achieved by driving the cutting arm to swing up and down.

The bolt support device 3 includes a lifting assembly 31, a work platform 32, a first drilling frame assembly 33 and a stabilizing assembly 34. The lifting assembly 31 is arranged between the rack 1 and the work platform 32, and the lifting assembly 31 is configured to lift the work platform 32. The first drilling frame assembly 33 and the stabilizing assembly 34 are arranged on the work platform 32. The first drilling frame assembly 33 has a bolt support position and an avoidance position. In the bolt support position, the first drilling frame assembly 33 is located above the cutting device 2 and is suitable for bolt support operations. In the avoidance position, the first drilling frame assembly 33 is configured to avoid the cutting device 2, so that the cutting device 2 can perform the cutting operations. The work platform 32 can extend and retract to switch the bolt support position and the avoidance position of the first drilling frame assembly 33. The stabilizing assembly 34 may be supported between the cutting device 2 and a tunnel roof to enhance the stability of the first drilling frame assembly 33 during the bolt support operations.

Figure 8:
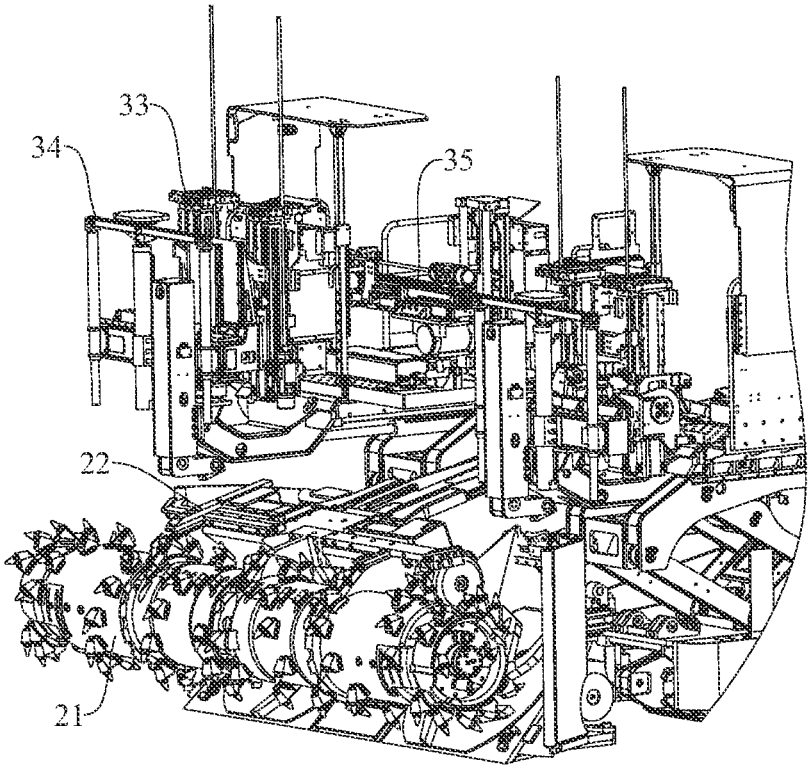
FIG. 8 is a schematic view of a front end of the bolter miner in FIG. 5.

Specifically, as shown in FIG. 6 and FIG. 8, the lifting assembly 31 may be mounted on the rack 1, and the lifting assembly 31 may include a lifting platform and a lifting oil cylinder. The lifting platform is fixed at a top of the lifting oil cylinder, and the lifting of the lifting platform may be driven by the lifting oil cylinder. The work platform 32 may be fixed on the lifting platform, and the lifting of the work platform 32 may be achieved by the lifting assembly 31.

It should be noted that the work platform 32 may be a rectangular platform, and the work platform 32 extends in the front-rear direction and is retractable in the front-rear direction. The first drilling frame assembly 33 may be mounted at a front end of the work platform 32, and the first drilling frame assembly 33 is used for the bolt support operations. Specifically, when the work platform 32 extends forwards, the first drilling frame assembly 33 is generally located above the cutting drum 21 of the cutting device 2, and the first drilling frame assembly 33 can perform the bolt support operations on the tunnel roof close to a heading face. At this time, the first drilling frame assembly 33 is in the bolt support position.

When the cutting operations need to be carried out, the work platform 32 may be retracted, and the first drilling frame assembly 33 may be withdrawn to the rear of the cutting drum 21 of the cutting device 2, so that the cutting device 2 may drive the cutting drum 21 to move up and down through the cutting arm, thus achieving the cutting operations. At this time, the first drilling frame assembly 33 is switched to the avoidance position, thus avoiding interference with the cutting device 2.

As shown in FIG. 6, the stabilizing assembly 34 may be mounted at the front end of the work platform 32, and the stabilizing device 34 may be located on a front side of the first drilling frame assembly 33. The stabilizing assembly 34 may be a telescopic oil cylinder. When the first drilling frame assembly 33 switches to the bolt support position, the stabilizing assembly 34 may extend and be pressed against and in contact with a top side of the cutting device 2, thus temporarily supporting the front end of the work platform 32, and avoiding a situation that the work platform 32 overhangs forwards relatively long. On the one hand, a problem that the work platform 32 tends to be bent and deformed can be avoided; on the other hand, vibration of the first drilling frame assembly 33 during the bolt support operations can be reduced, thus realizing a structural stabilization function.

It should be noted that, in some other embodiments, the stabilizing assembly 34 may also be pressed against and in contact with the tunnel roof, and the stabilizing assembly 34 may also be pressed against and in contact with the tunnel roof and the cutting device 2 simultaneously. In some other embodiments, the stabilizing assembly 34 may also be pressed against and in contact with a lateral wall of the tunnel, thereby performing the bolt support operations on the lateral wall of the tunnel.

It should be understood that, when the avoidance position and the bolt support position of the first drilling frame assembly 33 is adjusted, the position of the first drilling frame assembly 33 may be adjusted by the lifting assembly 31 and the work platform 32 in cooperation. For example, when there is a foreign object under the cutting drum 21 and the cutting arm cannot be swung to the lowest position, the work platform 32 may be lifted by the lifting assembly 31 to a position that matches the height of the cutting drum 21. Then, the work platform 32 may extend forwards, and the stabilizing assembly 34 is pressed against and in contact with the cutting device 2.

During tunneling, the bolter miner 100 may adopt two operation modes, i.e., a parallel operation and a non-parallel operation. The parallel operation refers to an operation mode that tunneling and bolt support are performed simultaneously. During operation, the first drilling frame assembly 33 needs to be withdrawn to the avoidance position. At this time, the cutting device 2 may perform the cutting operations in front, and the first drilling frame assembly 33 may perform the bolt support operations behind the cutting device 2. The parallel operation mode is suitable for tunnel roofs in good conditions. In this case, there may be a certain unsupported roof distance between the tunnel heading face and the bolt support position.

The non-parallel operation refers to that the tunneling and the bolt support are performed alternately. During the non-parallel operation, the cutting feed into the coal wall is first completed by the cutting drum 21, then the cutting drum 21 may be swung to the lowest position by the cutting arm, and then the first drilling frame assembly 33 may be moved above the cutting drum 21 by the lifting assembly 31 and the work platform 32, thus completing the bolt support operation. The non-parallel operation mode is suitable for tunnel roofs in poor conditions. After the heading face is advanced by one footage, the tunnel roof close to the heading face can get support timely, and the unsupported roof distance at the heading face can be shortened, thus avoiding collapse of the tunnel roof, and improving the safety of tunneling operations.

Figure 2:
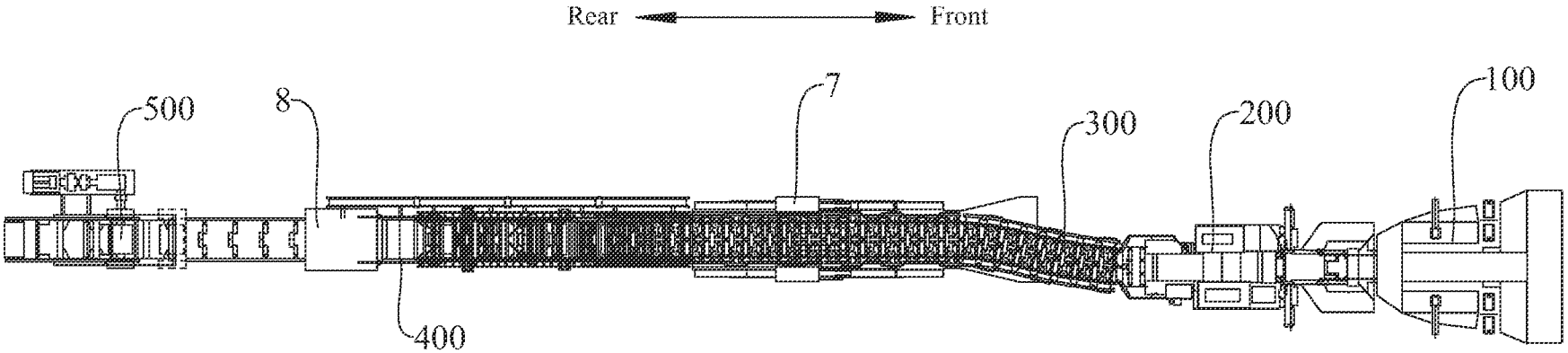
FIG. 2 is a top view of a tunneling system according to an embodiment of the present disclosure.

The bolter-integrated transportation machine 200 is arranged behind the bolter miner 100 and is configured to transfer the coal rock cut and conveyed by the bolter miner 100. Specifically, as shown in FIG. 1 and FIG. 2, the bolter-integrated transportation machine 200 is located on a rear side of the bolter miner 100 and is arranged adjacent to the bolter miner 100. When in use, the bolter-integrated transportation machine 200 may be moved synchronously with the bolter miner 100. For example, after the bolter miner 100 is advanced by one circulating footage, the bolter-integrated transportation machine 200 may be moved forwards by one circulating footage synchronously. Consequently, the bolter-integrated transportation machine 200 can transfer the coal rock conveyed from the conveying trough device of the bolter miner 100 at any time.

It should be noted that, the bolter-integrated transportation machine 200 also has the function of bolt support, and the bolter-integrated transportation machine 200 may include a roof bolter, so that the bolter-integrated transportation machine 200 can perform the bolt support on the rear side of the bolter miner 100 simultaneously during the bolt support of the bolter miner 100, which is beneficial to improving the tunneling efficiency.

One end of the transfer machine 300 is connected with the bolter-integrated transportation machine 200 and is configured to move synchronously with the bolter-integrated transportation machine 200. The transfer machine 300 is configured to be bent, and the transfer machine 300 is arranged behind the bolter-integrated transportation machine 200. The transfer machine 300 is configured to transfer the coal rock conveyed by the bolter-integrated transportation machine 200, and the other end of the transfer machine 300 is lapped with the self-moving tail 400. The self-moving tail 400 is configured to transfer the coal rock conveyed by the transfer machine 300.

Figure 3:
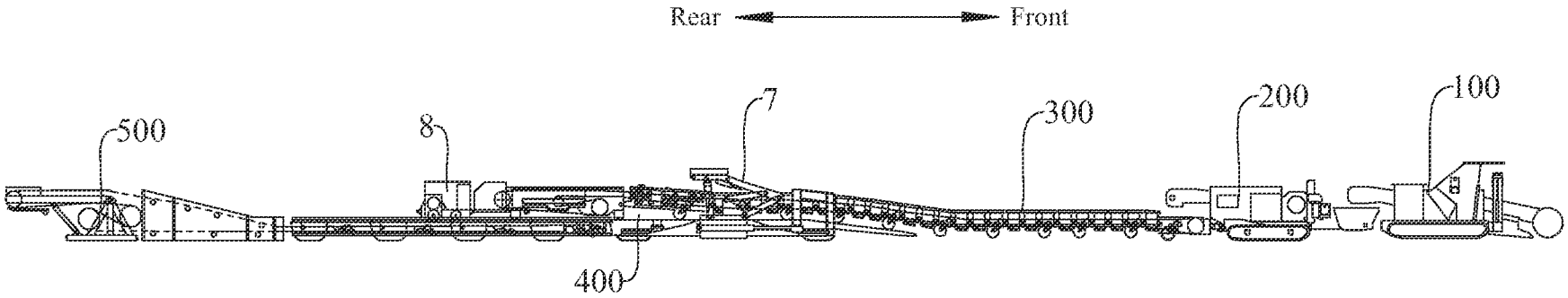
FIG. 3 is a schematic view of a transfer machine after moving forwards according to an embodiment of the present disclosure.

Specifically, as shown in FIGS. 1-3, the transfer machine 300 may be arranged behind and adjacent to the bolter-integrated transportation machine 200. A front end of the transfer machine 300 may be connected with the bolter-integrated transportation machine 200 by a pin shaft, and a rear end of the transfer machine 300 may be lapped with the self-moving tail 400. The transfer machine 300 is configured to slide by itself relative to the self-moving tail 400. Consequently, when the bolter-integrated transportation machine 200 is moved forwards, the transfer machine 300 can be moved forwards synchronously with the bolter-integrated transportation machine 200, and the rear end of the transfer machine 300 slides forwards along the self-moving tail 400.

Figure 4:
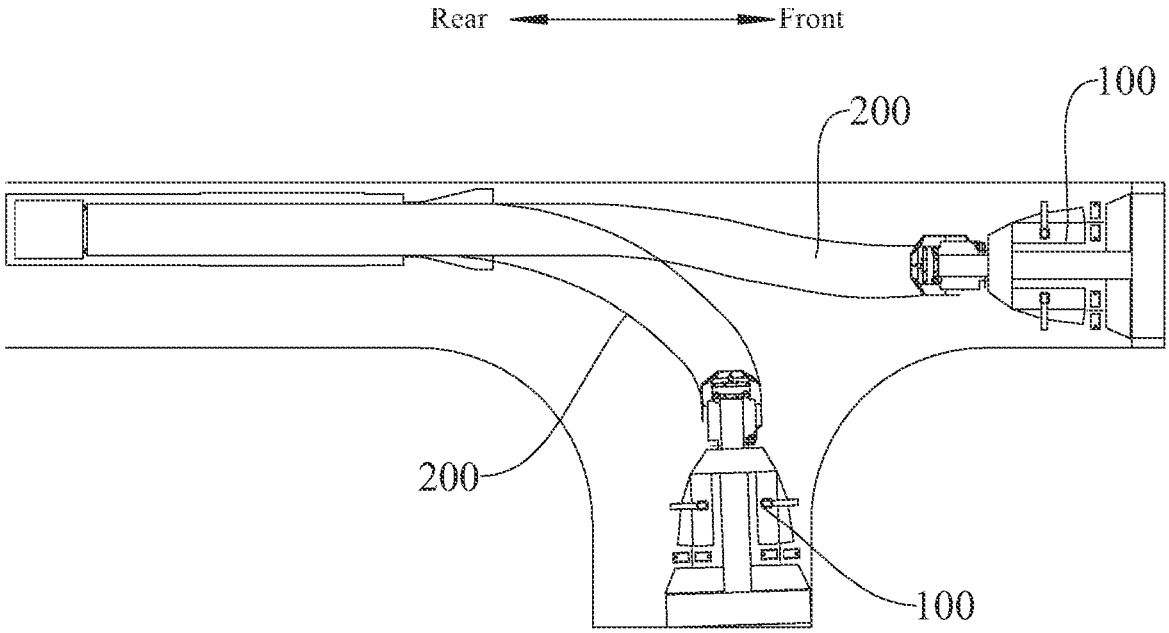
FIG. 4 is a schematic view of bending of a transfer machine according to an embodiment of the present disclosure.

As shown in FIG. 4, the transfer machine 300 may be bent in the left-right direction. For example, the transfer machine 300 may include a plurality of transport units, and two adjacent transport units may swing slightly relative to each other in the up-down direction and the left-right direction, thus achieving the flexibility of the transfer machine 300. Consequently, the turning of the tunneling system is facilitated, and the tunneling flexibility of the tunneling system is improved.

The belt conveyor 500 is arranged behind the self-moving tail 400, and the belt conveyor 500 is configured to transfer the coal rock conveyed by the self-moving tail 400. Specifically, as shown in FIGS. 1-3, the belt conveyor 500 may be connected with a rear end of the self-moving tail 400, and the coal rock conveyed via the self-moving tail 400 may be directly transferred to the belt conveyor 500, and then may be transported to a main tunnel or the ground via the belt conveyor 500.

The tunneling system according to the embodiment of the present disclosure can achieve the parallel operation and the non-parallel operation of tunneling and bolt support, and the corresponding tunneling mode may be selected pertinently according to different tunnel roof conditions, so that the flexibility of the tunneling process is improved, and this is beneficial to ensuring the tunneling safety and the tunneling efficiency. In the non-parallel operation, the bolt support may be performed on the tunnel roof close to the heading face, thus avoiding the situation that there is a large unsupported roof distance at the heading face, and ensuring the safe tunneling of the tunnel roofs in poor conditions.

In some embodiments, the self-moving tail 400 includes a self-moving bracket 7 and a driving device 8, the self-moving bracket 7 is arranged at a front end of the self-moving tail 400, and the driving device 8 is arranged at the rear end of the self-moving tail 400. The self-moving tail 400 may walk to drive the self-moving tail 400 to move forwards, and the driving device 8 is configured to drive the self-moving tail 400 to move backwards.

Specifically, as shown in FIGS. 1-3, the self-moving bracket 7 may be a walking hydraulic bracket, and the self-moving bracket 7 includes an upright oil cylinder and a driving oil cylinder. When in use, the upright oil cylinder may be supported between the tunnel roof and a tunnel floor, and then the driving oil cylinder may be retracted to pull the self-moving tail 400. Before pulling, the upright oil cylinder may be retracted, and then the upright oil cylinder may be pushed forwards by means of the driving oil cylinder. Consequently, this facilitates the automatic forward movement of the self-moving tail 400.

The driving device 8 may be a driving gear, and a front end of the belt conveyor 500 may be provided with a pin rail. The driving gear and the pin rail are meshed for transmission, and the self-moving tail 400 is moved backwards through the rotation of the driving gear. The arrangement of the self-moving bracket 7 and the driving device 8 facilitates the forward and backward adjustment of the position of the self-moving tail 400.

In some embodiments, the bolter-integrated transportation machine 200 includes a crushing device 6 configured to the crush coal rock to facilitate transfer and transportation of the coal rock. As shown in FIG. 1, the crushing device 6 may be a crusher, the coal rock conveyed by the bolter miner 100 may be first transported to the crushing device 6, and the coal rock will be crushed into blocks with smaller particle sizes by the crushing device 6, thus facilitating the transfer and transportation between two adjacent apparatuses.

In some embodiments, a lapping distance between the transfer machine 300 and the self-moving tail 400 is not less than 150 meters, and this lapping distance can meet the footage requirement of the bolter miner 100 in one day, thus reducing the moving frequency of the self-moving tail 400, and improving the production efficiency.

In some embodiments, the bolt support device 3 includes a first bolt support device 301 and a second bolt support device 302, and the first bolt support device 301 and the second bolt support device 302 are arranged at intervals along a width direction of the rack 1. The first bolt support device 301 is configured to perform bolt support operations on a side of the tunnel, the second bolt support device 302 is configured to perform bolt support operations on another side of the tunnel, and the first bolt support device 301 and the second bolt support device 302 may perform staggered bolt support operations in a length direction of the rack 1.

Figure 7:
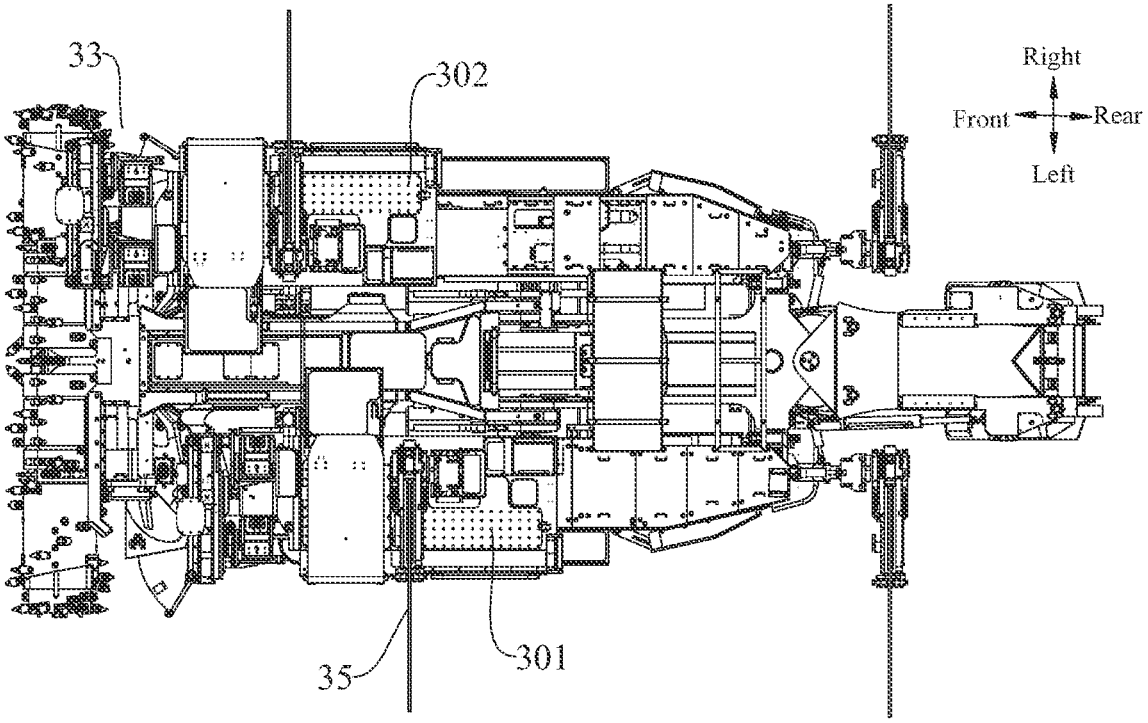
FIG. 7 is a top view of the bolter miner in FIG. 5.
Figure 9:
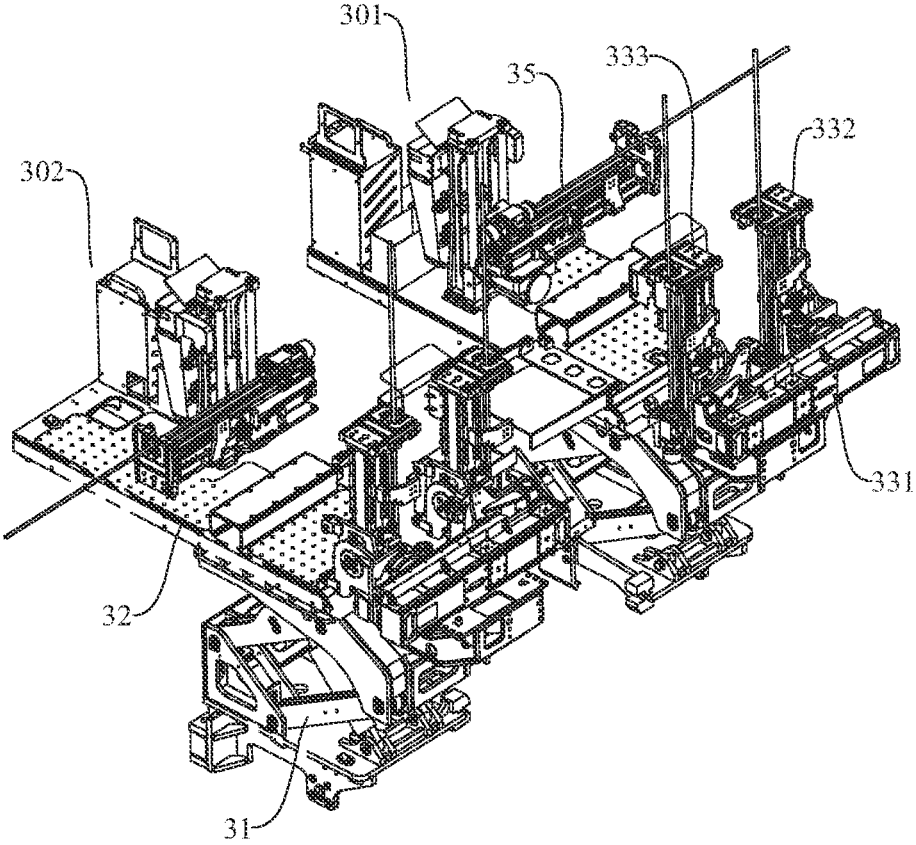
FIG. 9 is a schematic view of a bolt support device of the bolter miner in FIG. 5.
Figure 10:
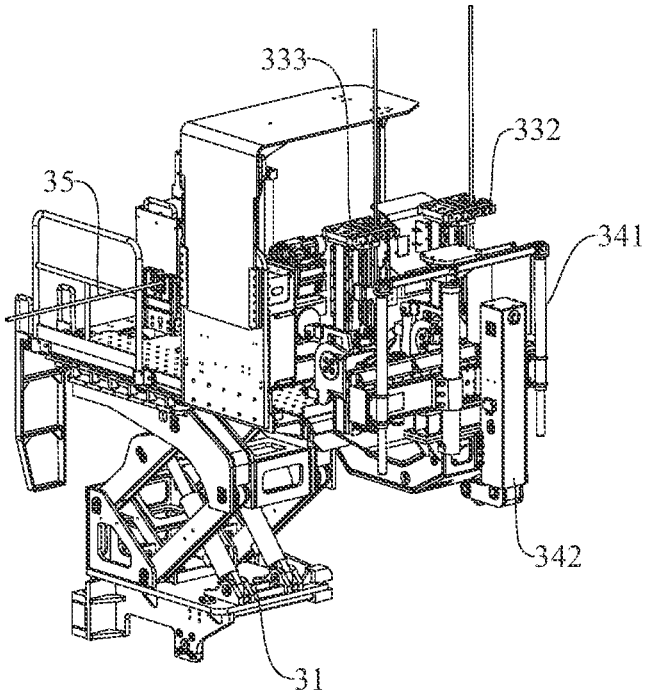
FIG. 10 is a schematic view of a single bolt support device in FIG. 9.

Specifically, as shown in FIG. 7 and FIG. 9, there may be two bolt support devices 3, namely, the first bolt support device 301 and the second bolt support device 302, arranged in parallel and spaced apart from each other in the left-right direction (i.e., the width direction of the rack 1). The first bolt support device 301 may be arranged on a left side of the rack 1, and the first bolt support device 301 mainly performs bolt support operations on the roof and lateral wall on the left side of the tunnel. The second bolt support device 302 may be arranged on a right side of the rack 1, and the second bolt support device 302 mainly performs bolt support operations on the roof and lateral wall on the right side of the tunnel.

On the one hand, the first bolt support device 301 and the second bolt support device 302 can perform the bolt support operations on the tunnel simultaneously, thus enhancing the bolt support efficiency. On the other hand, the conveying trough device 5 may be arranged between the first bolt support device 301 and the second bolt support device 302, thus facilitating the mounting of the conveying trough device 5, and avoiding the situation that a single bolt support device 3 tends to interfere with the conveying trough device 5 when the bolt support device 3 is moved left or right.

It may be understood that, in some other embodiments, there may be only one bolt support device 3, and in this case, the bolt support device 3 may perform the bolt support operations on the roof of the tunnel and the lateral walls on both sides of the tunnel.

It should be noted that, as shown in FIG. 7, the first drilling frame assembly 33 of the first bolt support device 301 and the first drilling frame assembly 33 of the second bolt support device 302 may be arranged at intervals in the front-rear direction (i.e., a staggered arrangement), so that the bolt support operations on both sides may be staggered in space, thus avoiding the situation that the operation space is cramped when operating at the same width section, and further improving the flexibility of the bolt support operation.

In some embodiments, the first drilling frame assembly 33 includes a mounting seat 331 and an anchor drill, the mounting seat 33 is arranged on the work platform 32, the anchor drill is arranged on the mounting seat 331, the position of the anchor drill relative to the mounting seat 331 in the width direction of the rack 1 is adjustable, and the anchor drill is rotatable relative to the mounting seat 331.

Specifically, as shown in FIG. 9, the mounting seat 331 may be rectangular, and the mounting seat 331 may be fixed at the front end of the work platform 32 by fasteners such as bolts, and the mounting seat 331 extends in the left-right direction. The anchor drill, i.e., a roof bolter, may be assembled on the mounting seat 331 in a guided manner. For example, the anchor drill may be assembled with the mounting seat 331 in the guided manner through a guide groove and a slider. Consequently, the anchor drill may slide left or right on the mounting seat 331, thus allowing for bolt support at different tunnel width positions.

The anchor drill may be rotatably connected with the mounting seat 331 through swing drive. Consequently, the anchor drill may swing in the left-right direction, so that the anchor drill can perform the bolt support operations on the roof of the tunnel and also on the lateral wall of the tunnel, thus improving the flexibility in use of the anchor drill.

In some embodiments, the mounting seat 331 includes a first seat 3311 and a second seat 3312, and the first seat 3311 and the second seat 3312 extend along the width direction of the rack 1. The first seat 3311 is arranged on the rack 1, and the second seat 3312 is arranged on the first seat 3311. The position of the second seat 3312 relative to the first seat 3311 in the width direction of the rack 1 is adjustable. The anchor drill includes a first anchor drill 332 and a second anchor drill 333. The first anchor drill 332 and the second anchor drill 333 are arranged on the second seat 3312, and the position of at least one of the first anchor drill 332 and the second anchor drill 333 relative to the second seat 3312 in the width direction of the rack 1 is adjustable.

Figure 16:
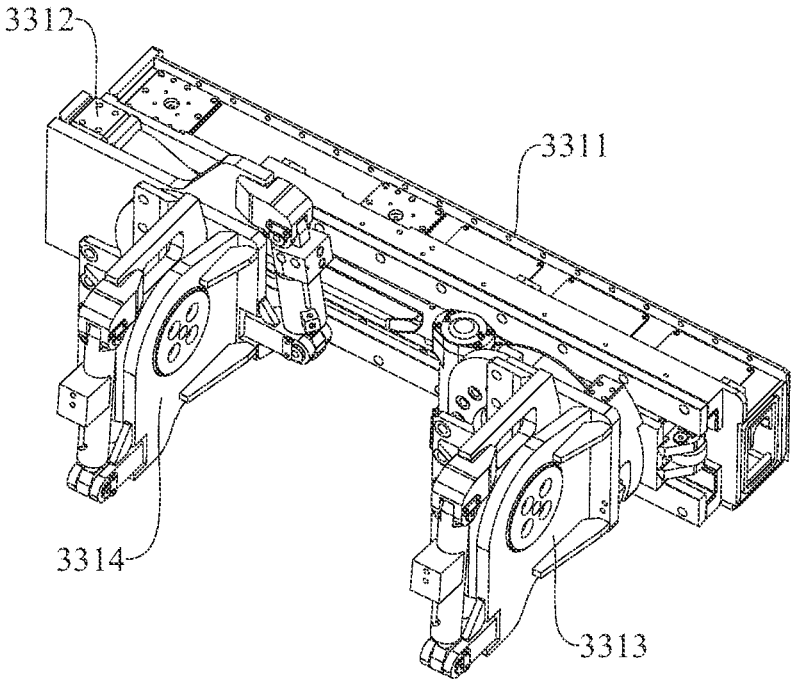
FIG. 16 is a schematic view a mounting seat of a first drilling frame assembly in FIG. 10.
Figure 17:
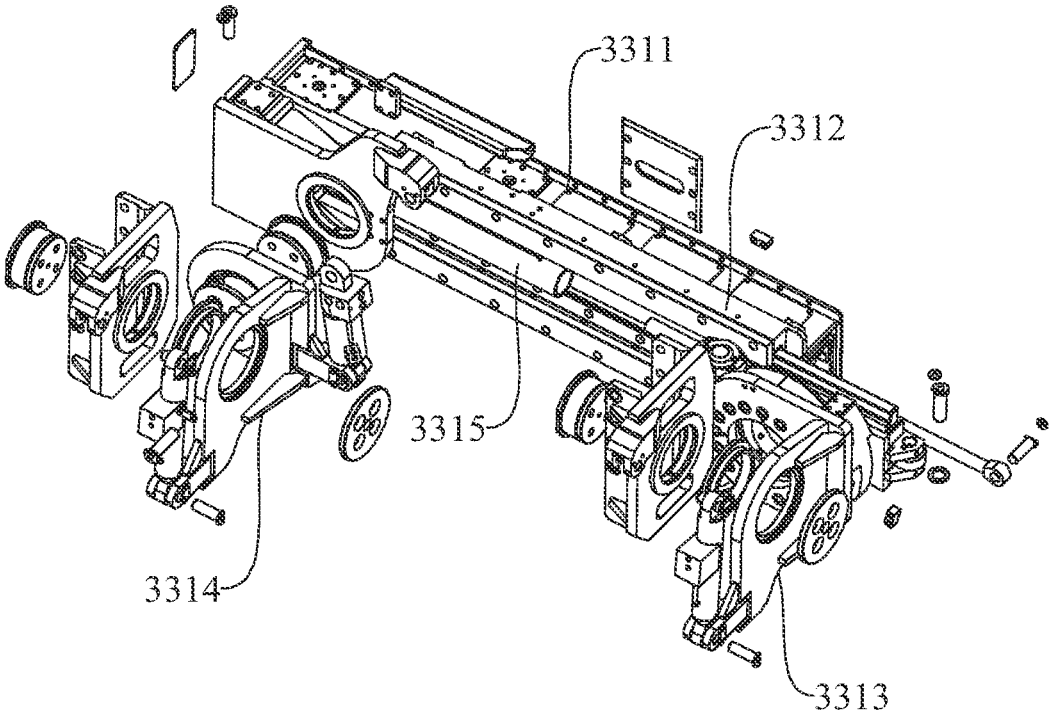
FIG. 17 is an exploded view of the mounting seat in FIG. 16.
Figure 18:
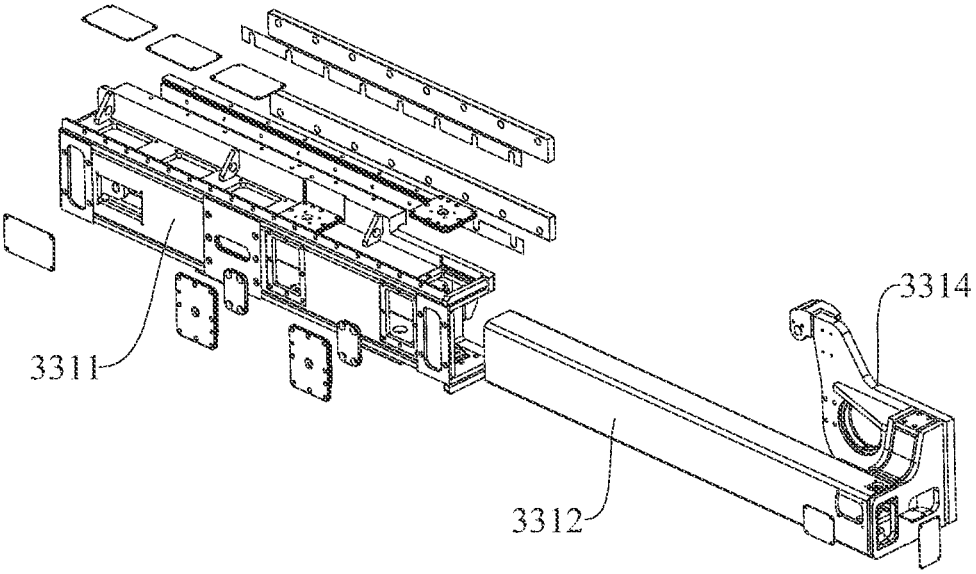
FIG. 18 is a schematic view of a first seat and a second seat in FIG. 16.

Specifically, as shown in FIGS. 16-18, the first seat 3311 may have a shape of a square cylinder, and the second seat 3312 may have a rectangular parallelepiped shape. The second seat 3312 is fitted in the first seat 3311 and is movable along an extension direction of the first seat 3311. There may be a hydraulic telescopic cylinder in the first seat 3311, and the hydraulic telescopic cylinder may drive the first seat 3311 and the second seat 3312 to achieve a relative position therebetween.

There may be two anchor drills, namely, the first anchor drill 332 and the second anchor drill 333. Both the first anchor drill 332 and the second anchor drill 333 are assembled on the second seat 3312. Consequently, when the second seat 3312 is translated in the left-right direction, the first anchor drill 332 and the second anchor drill 333 will also be translated synchronously, thus achieving the adjustment of positions of the first anchor drill 332 and the second anchor drill 333 in the left-right direction.

As shown in FIG. 17, the first anchor drill 332 may be arranged on an outer side of the second anchor drill 333 (i.e., a side close to the lateral wall of the tunnel), the second anchor drill 333 may be fixed at an end of the second seat 3312, and the first anchor drill 332 may be slidably assembled on the second seat 3312 in a guided manner, that is, the position of the second anchor drill 333 along an extension direction of the second seat 3312 is not adjustable, and the position of the first anchor drill 332 along the extension direction of the second seat 3312 is adjustable. Consequently, the second anchor drill 333 is mainly configured to perform bolt support operations on the tunnel roof, and the first anchor drill 332 is mainly configured to perform bolt support operations on the lateral wall of the tunnel.

As shown in FIG. 17, a first drill block 3313 and a second drill block 3314 are arranged on the second seat 3312. The first anchor drill 332 may be connected with the second seat 3312 through the first drill block 3313, and the second anchor drill 333 may be connected with the second seat 3312 through the second drill block 3314. The first drill block 3313 is assembled with the second seat 3312 in a guided manner, and a drill block driver 3315 is arranged between the second seat 3312 and the first drill block 3313. One end of the drill block driver 3315 is hinged with the second seat 3312, and the other end of the drill block driver 3315 is hinged with the first drill block 3313. Consequently, the position of the first anchor drill 332 may be adjusted by the drill block driver 3315. It may be understood that, in some other embodiments, both the first anchor drill 332 and the second anchor drill 333 may be assembled on the second seat 3312 in a guided manner.

The first drill block 3313 and the second drill block 3314 may be swing-driven, so that both the first drill block 3313 and the second drill block 3314 may swing in the left-right direction, thus facilitating the adjustment of an anchor rod installation orientation.

During the operation, the position of the second seat 3312 may be adjusted by a corresponding driver, so that the position of the second anchor drill 333 may be adjusted. The position of the second seat 3312 may be adjusted by the corresponding driver, and then the position of the first anchor drill 332 may be adjusted by the drill block driver 3315, so that the adjustment of the position of the first anchor drill 332 in the left-right direction is achieved, thus improving the adaptability to tunnels with different widths.

In some embodiments, in the width direction of the rack 1, the first anchor drill 332 is located on the outer side of the second anchor drill 333, the second anchor drill 333 is arranged on the second seat 3312 and is rotatable in the length direction and/or the width direction of the rack 1, the first anchor drill 332 is arranged on the second seat 3312 and is adjustable in terms of its position relative to the second seat 3312 in the width direction of the rack 1, and the first anchor drill 332 is rotatable in the length direction and/or the width direction of the rack 1.

Specifically, as shown in FIG. 17, the first drill block 3313 may have two rotation axes, one of the two rotation axes extends along the front-rear direction, and the other one of the two rotation axes extends along the left-right direction. Consequently, the first anchor drill 332 may swing in the left-right direction (the width direction of the rack 1) and also in the front-rear direction (the length direction of the rack 1), thus further improving the flexibility in adjusting an anchor rod installation direction, and facilitating bolt support construction operations with different inclination angles.

In some embodiments, in the length direction of the rack 1, the stabilizing assembly 34 is located on an outer side of the first drilling frame assembly 33, and a first blocking member 326 is connected between the second seat 3312 and the stabilizing assembly 34. The first blocking member 326 is configured to unfold to block the coal rock when the second seat 3312 is moved.

Figure 19:
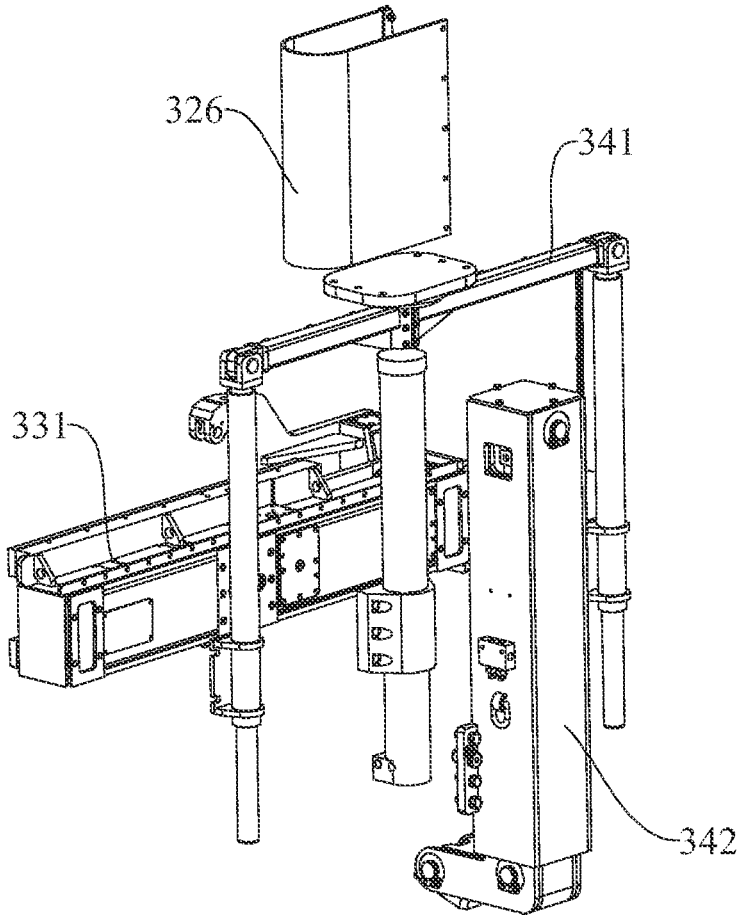
FIG. 19 is a schematic view of a stabilizing assembly in FIG. 10.

Specifically, as shown in FIG. 19, the stabilizing assembly 34 is arranged on the front side of the first drilling frame assembly 33. The first blocking member 326 may be a piece of rubber. One side of the first blocking member 326 is fixedly connected with the second seat 3312, and the other side of the first blocking member 326 is fixedly connected with the stabilizing assembly 34. When the second seat 3312 slides in the left-right direction, the first blocking member 326 will be stretched and unfolded by the second seat 3312. Consequently, the first blocking member 326 will block the front side of the first drilling frame assembly 33, thus avoiding the situation that the coal rock falls on the apparatuses and operators, and achieving a protection effect.

In some embodiments, the stabilizing assembly 34 includes a first support assembly 341 and a second support assembly 342, and the first support assembly 341 and the second support assembly 342 are arranged on the work platform 32. The first support assembly 341 may extend upwards and is configured to support the tunnel roof, and the second support assembly 342 may extend downwards and is configured to support the cutting device 2.

Specifically, as shown in FIG. 19, both the first support assembly 341 and the second support assembly 342 may be detachably mounted at the front end of the work platform 32 through fasteners such as bolts. The first support assembly 341 and the second support assembly 342 may both be hydraulic telescopic cylinders. The first support assembly 341 may extend upwards and support the tunnel roof, and the second support assembly 342 may extend downwards and support the cutting device 2. On the one hand, the arrangement of the first support assembly 341 and the second support assembly 342 enhances the structural stability during the bolt support operation, and on the other hand, the first support assembly 341 and the second support assembly 342 may operate independently, thereby improving the support reliability.

In some embodiments, the first support assembly 341 includes a first support driver 3411, a crossbar 3412 and a second blocking member (not shown). The first support driver 3411 is connected with the work platform 32, a free end of the first support driver 3411 is configured to support the tunnel roof, the crossbar 3412 is connected with the free end of the first support driver 3411, the second blocking member is connected between the crossbar 3412 and the work platform 32, and the second blocking member is configured to unfold to block the coal rock when the first support driver 3411 provides support.

Figure 20:
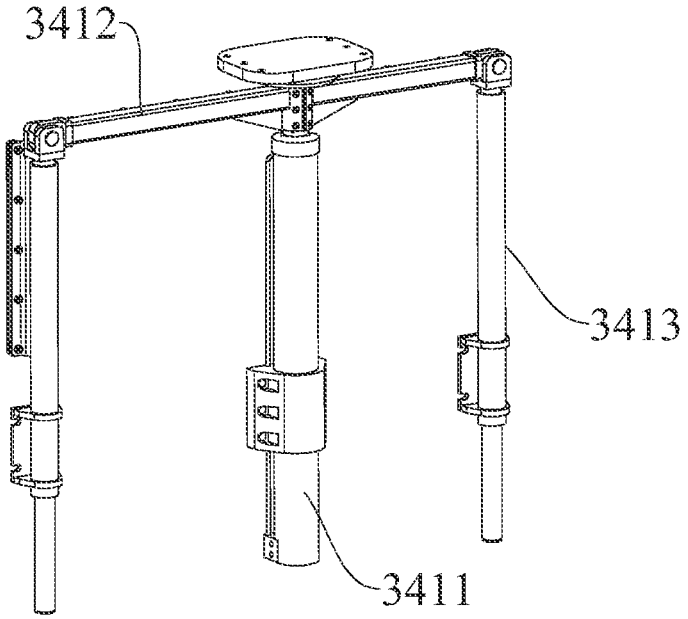
FIG. 20 is a schematic view of a first support assembly in FIG. 19.

Specifically, as shown in FIG. 20, the first support driver 3411 may be a hydraulic telescopic cylinder, the first support driver 3411 extends in the up-down direction, and a top end of the first support driver 3411 is configured to support the tunnel roof. The crossbar 3412 is fixed at the top of the first support driver 3411, and extends along the left-right direction. The second blocking member may be a chain curtain, a top end of the second blocking member is connected with the crossbar 3412, and a bottom end of the second blocking member is connected with the first seat 3311. Consequently, when the first support driver 3411 extends, the second blocking member may be driven by the crossbar 3412 to unfold, so as to block the first drilling frame assembly 33, thus further protecting the apparatuses and operators.

In some embodiments, as shown in FIG. 20, the top end of the first support driver 3411 is provided with a support top plate, and the support top plate may be a rectangular plate. The support top plate can increase an action area with the tunnel roof, and enhance the stabilization effect.

It may be understood that, in some other embodiments, the second blocking member may also be a flexible blocking member such as a piece of rubber.

In some embodiments, the first support assembly 341 includes a plurality of guide rods 3413, and the plurality of guide rods 3413 are arranged at intervals along an extension direction of the crossbar 3412. The guide rod 3413 is connected between the crossbar 3412 and the work platform 32, and the guide rod 3413 is configured to limit a driving direction of the first support driver 3411.

Specifically, as shown in FIG. 20, there may be two guide rods 3413, and the first support driver 3411 may be arranged between the two guide rods 3413. One of the two guide rods 3413 has a top end connected with one end of the crossbar 3412 and a bottom end connected with the first seat 3311. The other one of the two guide rods 3413 has a top end connected with the other end of the crossbar 3412 and a bottom end connected with the first seat 3311. The guide rod 3413 may include an inner rod and an outer rod, the outer rod is fixed on the first seat 3311, and the inner rod is fitted in the outer rod in a guided manner. The guide rod 3413 has a guiding effect and enhances the structural strength.

In some embodiments, the first blocking member 326 may be fixedly connected with the outer rod.

In some embodiments, the second support assembly 342 includes a support inner cylinder 3422, a support outer cylinder 3421 and a second support driver 3424. The support outer cylinder 3421 is arranged on the work platform 32, the support inner cylinder 3422 is fitted in the support outer cylinder 3422 and is slidable relative to the support outer cylinder 3422, and the second support driver 3424 is arranged in the support outer cylinder 3421. One end of the second support driver 3424 is connected with the support outer cylinder 3421, and the other end of the second support driver 3424 is connected with the support inner cylinder 3424. The second support driver 3424 is configured to drive the support inner cylinder 3422 to move, so as to allow the second support assembly 342 to support the cutting device 2.

Figure 21:
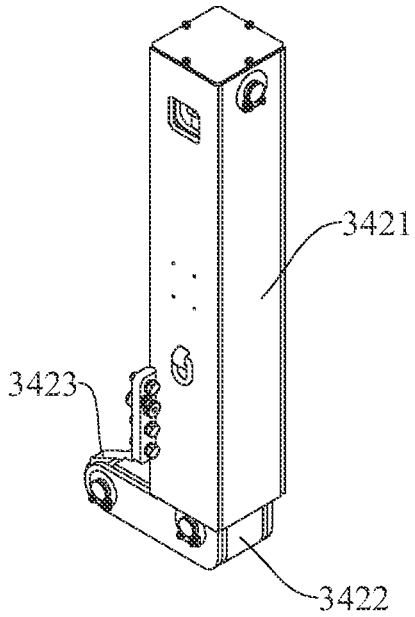
FIG. 21 is a schematic view of a second support assembly in FIG. 19.
Figure 22:
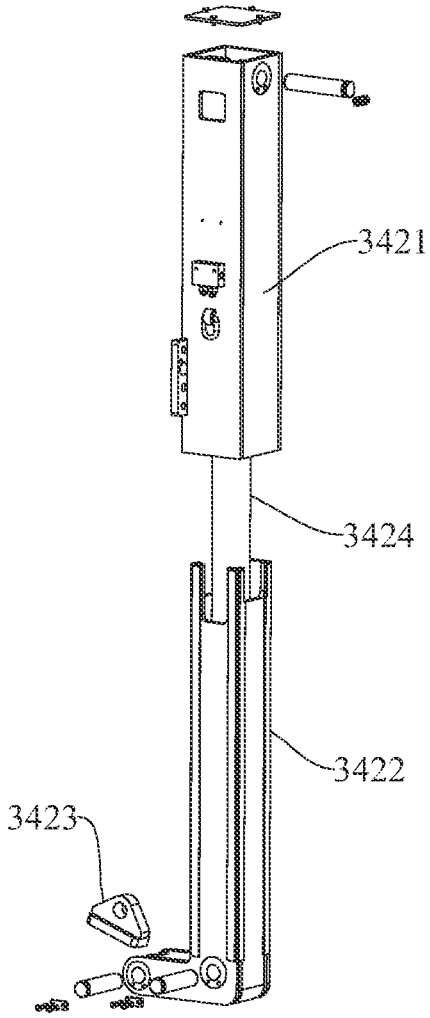
FIG. 22 is an exploded view of a second support assembly in FIG. 21.

Specifically, as shown in FIG. 21 and FIG. 22, the support inner cylinder 3422 and the support outer cylinder 3421 are both square cylinders. The support outer cylinder 3421 is fixed on a front side of the work platform 32 or a front side of the first seat 3311, and the support inner cylinder 3422 is fitted in the support outer cylinder 3421. The second support driver 3424 may be a hydraulic telescopic cylinder, and the second support driver 3424 may be arranged in the support outer cylinder 3421. A top end of the second support driver 3424 is connected with the support outer cylinder 3421, and a bottom end of the second support driver 3424 is connected with the support inner cylinder 3422. The downward movement of the support inner cylinder 3422 may be achieved through extension of the second support driver 3424, and hence a bottom end of the support inner cylinder 3422 can support the cutting device 2.

Since the second support driver 3424 is arranged in the support outer cylinder 3421, the second support driver 3424 only needs to bear an axial force when in use, and a shear force is mainly borne by the support inner cylinder 3422 and the support outer cylinder 3421, so that the structural strength of the second support assembly 342 is enhanced, thus ensuring the stability and structural strength of the structure.

In some embodiments, the second support assembly 342 includes a pressure block 3423, and the pressure block 3423 is rotatably connected with a free end of the support inner cylinder 3422. The pressure block 3423 has a fitting surface, and the pressure block 3423 is configured to rotate to make the fitting surface and the cutting device 2 fit together when the second support assembly 342 supports the cutting device 2.

Specifically, as shown in FIG. 21 and FIG. 22, the pressure block 3423 may be a triangular block, and the pressure block 3423 may be rotatably connected with the bottom end of the support inner cylinder 3422 through a pivot. A bottom surface of the pressure block 3423 forms the fitting surface, and the fitting surface of the pressure block 3423 is always located below under the action of gravity. When the second support assembly 342 extends, the pressure block 3423 may be in contact with the cutting device 2, and the pressure block 3423 may rotate by itself under a fitting effect of the cutting device 2, so that the fitting surface of the pressure block 3423 can fully fit with the cutting device 2. On the one hand, the arrangement of the pressure block 3423 enhances a friction action area, thus enhancing the stabilization effect. On the other hand, the pressure block 3423 has a buffering effect, thus buffering transmission of a force during anchor rod operations.

In some embodiments, the cutting device 2 includes a support part 22, and the support part 22 extends along the length direction of the rack 1 to meet support for the pressure block 3423 after the work platform 32 is adjusted to different extension and retraction amounts.

Specifically, as shown in FIG. 8, the support part 22 may be integrated with the cutting device 2, and the support part 22 has a long strip shape and generally extends in the front-rear direction. When the second support assembly 342 extends, the pressure block 3423 of the second support assembly 342 may be pressed against the support part 22, thus achieving the support between the second support assembly 342 and the cutting device 2.

Since the support part 22 has a dimension extending along the front-rear direction, when the work platform 32 is adjusted to different extension and retraction amounts, the pressure block 3423 can still be pressed on the support part 22, which meets operation requirements of different extension and retraction amounts of the work platform 32, thereby enabling the first drilling frame assembly 33 to meet the requirements of anchor rod installation with different row spacing.

In some embodiments, a top surface of the support part 22 is configured to fit with the fitting surface of the pressure block 3423, and the top surface of the support part 22 is inclined downwards in a direction from the rear to the front. Consequently, a force acting on the support part 22 generates a backward component force, and a center of gravity of the bolter miner 100 is located on the rear side where a significant frictional effect exists, so that the component force can be effectively counteracted and the stability of the bolt support operations can be ensured.

In some embodiments, the support inner cylinder 3422 includes an inner cylinder section and an extension section, the inner cylinder section is fitted in the support outer cylinder in a guided manner, and the extension section is arranged at a free end of the inner cylinder section and is at an included angle with the inner cylinder section. The extension section extends towards a side of the rack 1, and the pressure block 3423 is rotatably connected with a free end of the extension section.

Specifically, as shown in FIG. 21 and FIG. 22, the inner cylinder section extends along the up-down direction, and the extension section extends along the front-rear direction. A front end of the extension section is connected with a bottom end of the inner cylinder section, and the pressure block 3423 is rotatably assembled at a rear end of the extension section. Consequently, when the front end of the work platform 32 extends to a front side of the cutting drum 21, the pressure block 3423 still can be located above the cutting device 2 and achieve support with the cutting device 2. The arrangement of the extension section can increase a forward displacement of the work platform 32, thereby increasing an operation range of the first drilling frame assembly 33.

In some embodiments, the first support assembly 341 includes a plurality of third support drivers 3414 and a ceiling panel 3415. The plurality of the third support drivers 3414 are arranged in parallel at intervals, one end of the third support driver 3414 is connected with the work platform 32, and the other end of the third support driver 3414 is rotatably connected with the ceiling panel 3415. The ceiling panel 3415 is configured to support the tunnel roof through the extension of the plurality of third support drivers 3414, and the ceiling panel 3415 can achieve inclination adjustment by adjusting the plurality of third support drivers 3414 to different extension and retraction amounts.

Figure 25:
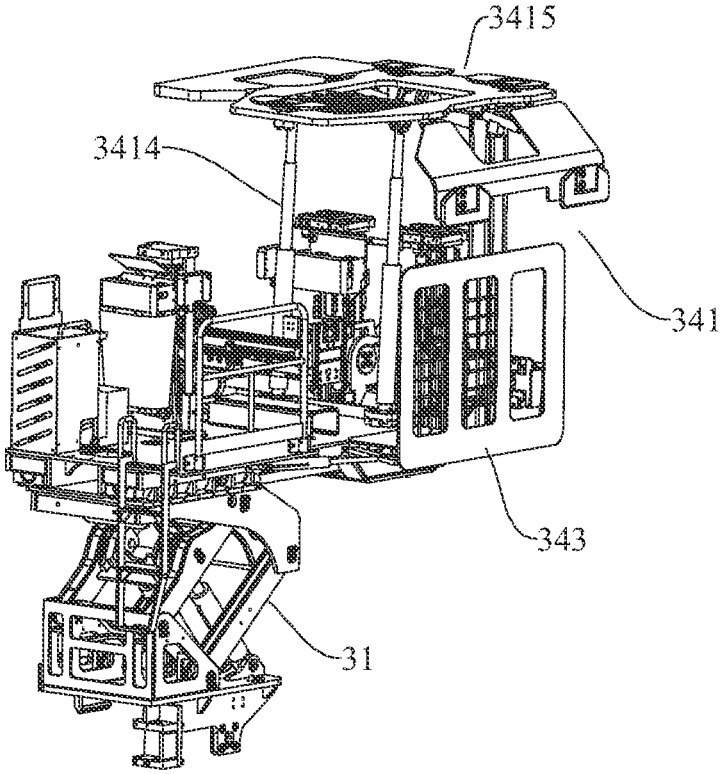
FIG. 25 is a schematic view of a stabilizing assembly according to another embodiment of the present disclosure.

Specifically, as shown in FIG. 25, the third support driver 3414 may be a hydraulic telescopic cylinder, and three third support drivers 3414 may be provided. One of the three third support drivers 3414 is arranged on the front side of the work platform 32, and the remaining two of the three third support drivers 3414 are arranged on the rear side and arranged in parallel and at intervals along the left-right direction. Respective bottom ends of the three third support drivers 3414 may all be fixedly connected with the work platform 32, for example, mounted and fixed by bolts. Consequently, the situation that the third support driver 3414 swings is avoided, so that the third support drivers 3414 can be prevented from swinging and only be allowed for telescopic movement in the up-down direction.

A top end of the third support driver 3414 may be hinged or pivotally connected with the ceiling panel 3415. Consequently, the ceiling panel 3415 may swing relative to the third support driver 3414. During use, the ceiling panel 3415 may be lifted by controlling the three third support drivers 3414 to extend synchronously, so that the ceiling panel 3415 may support the tunnel roof. When the tunnel roof is inclined or uneven, the three third support drivers 3414 may be adjusted to different extension and retraction amounts, so that the ceiling panel 3415 is obliquely arranged, thus improving the adaptability to the tunnel roof.

In some embodiments, the three third support drivers 3414 may all be connected with the ceiling panel 3415 through pivots, and all three pivots extend along the left-right direction, so that the ceiling panel 3415 may be inclined and adjusted in the front-rear direction.

In some embodiments, the ceiling panel 3415 includes a main ceiling 34151, an inner ceiling 34152 and an outer ceiling 34153. The plurality of third support drivers 3414 are connected with the main ceiling 34151, the inner ceiling 34152 is rotatably connected with the main ceiling 34151 and is located on an inner side of the main ceiling 34151, and a first ceiling driver 3416 is arranged between the inner ceiling 34152 and the main ceiling 34151. The first ceiling driver 3416 is configured to obliquely support the inner ceiling 34152 to realize the up-and-down swing of the inner ceiling 34152. The outer ceiling 34153 is rotatably connected with the main ceiling 34151 and is located on an outer side of the main ceiling 34151, and a second ceiling driver 3417 is arranged between the outer ceiling 34153 and the main ceiling 34151. The second ceiling driver 3417 is configured to obliquely support the outer ceiling 34153 to realize the up-and-down swing of the outer ceiling 34153.

Figure 26:
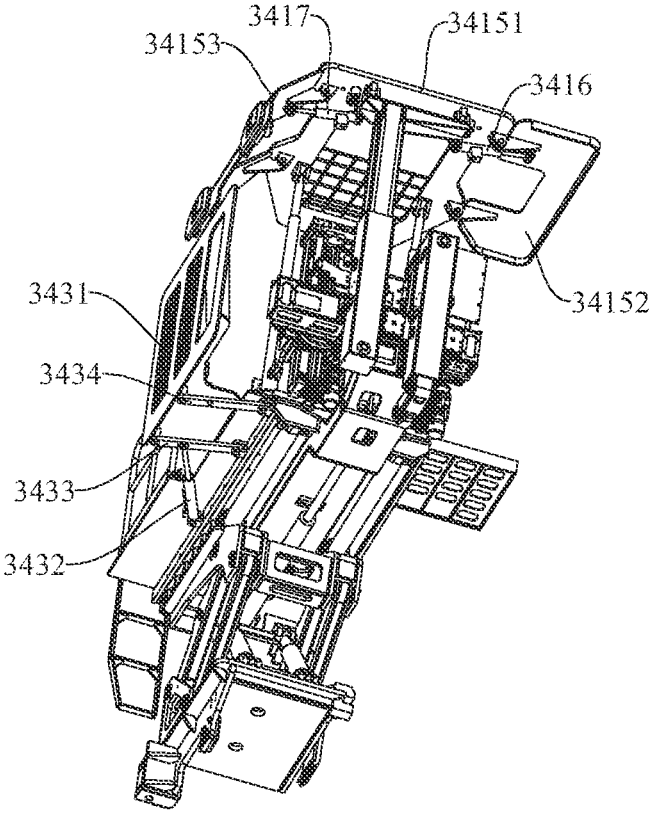
FIG. 26 is a bottom perspective view of the stabilizing assembly in FIG. 25.
Figure 27:
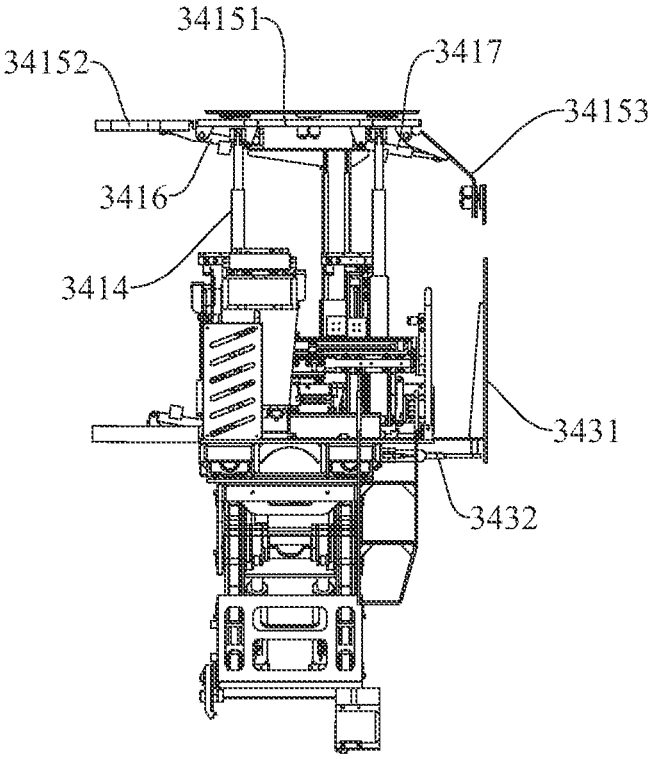
FIG. 27 is a rear view of the stabilizing assembly of FIG. 25.
Figure 28:
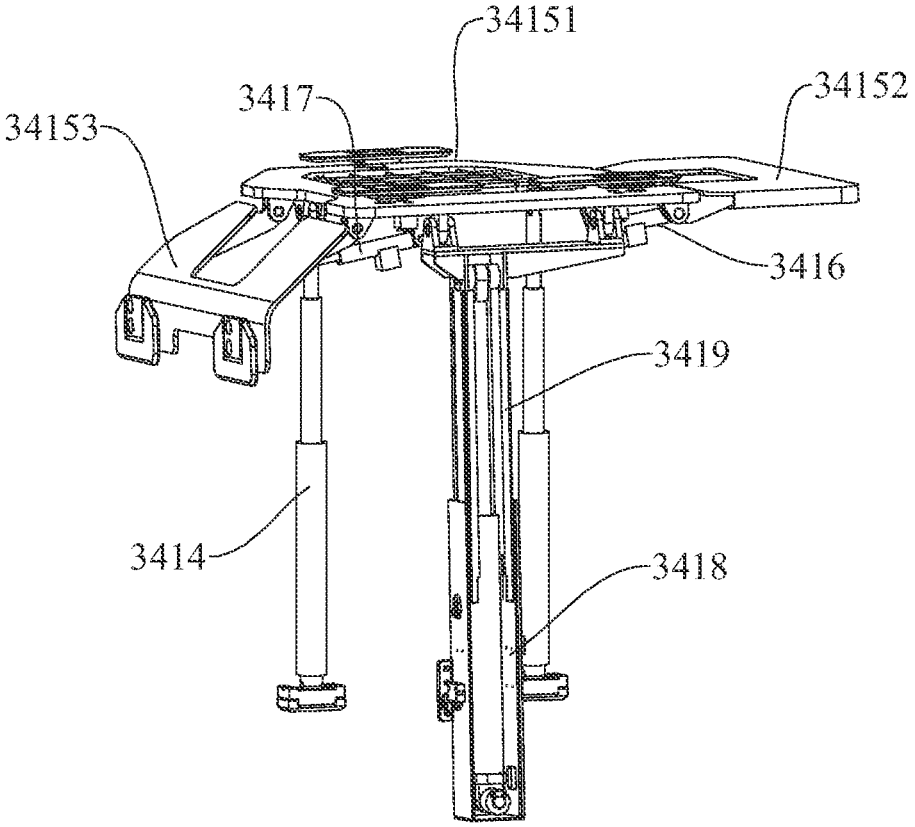
FIG. 28 is a schematic view of a first support assembly in FIG. 25.

Specifically, as shown in FIGS. 26-28, the inner ceiling 34152 may be pivotally assembled on the inner side of the main ceiling 34151 through a pivot shaft, and the first ceiling driver 3416 may be arranged below the main ceiling 34151 and the inner ceiling 34152. One end of the first ceiling driver 3416 may be hinged with the main ceiling 34151, and the other end of the first ceiling driver 3416 may be hinged with the inner ceiling 34152. The inner ceiling 34152 may swing up and down through the first ceiling driver 3416. The outer ceiling 34153 may be pivotally assembled on the outer side of the main ceiling 34151 through a pivot shaft, and the second ceiling driver 3417 may be arranged below the main ceiling 34151 and the outer ceiling 34153. One end of the second ceiling driver 3417 may be hinged with the main ceiling 34151 and the other end of the second ceiling driver 3417 may be hinged with the outer ceiling 34153. The outer ceiling 34153 may swing up and down through the second ceiling driver 3417.

The arrangement of the inner ceiling 34152 and the outer ceiling 34153 can not only increase an action area between the first support assembly 341 and the tunnel roof, but also make the shape of the ceiling panel 3415 adjustable, thereby improving the adaptability of the ceiling panel 3415 to the tunnel roof. In addition, during the movement of the bolter miner, the ceiling panel 3415 can be retracted, thereby improving the trafficability.

In some embodiments, the first support assembly 341 includes a limiting outer cylinder 3418 and a limiting inner cylinder 3419. The limiting outer cylinder 3418 is connected with the work platform 32, the limiting inner cylinder 3419 is slidably fitted in the limiting outer cylinder 3418 in a guided manner and is connected with the ceiling panel 3415, and the limiting outer cylinder 3418 and the limiting inner cylinder 3419 cover an outer side of the third support driver 3414 to limit a direction of extension and retraction of the third support driver 3414 when the third support driver 3414 extends and is retracted.

Specifically, as shown in FIG. 28, cross sections of the limiting outer cylinder 3418 and the limiting inner cylinder 3419 may be both square, so that the anti-rotation assembling of the limiting inner cylinder 3419 and the limiting outer cylinder 3418 may be realized. The limiting outer cylinder 3418 may be connected with the front end of the work platform 32 through bolts, and the limiting outer cylinder 3418 extends along the up-down direction. The limiting inner cylinder 3419 is fitted in the limiting outer cylinder 3418 in a guided manner, and a top end of the limiting inner cylinder 3419 may be rotatably assembled with the main ceiling 34151. Consequently, the limiting inner cylinder 3419 can only move along an extension direction of the limiting outer cylinder 3418, thus playing a role of limiting the direction of extension and retraction of the third support driver 3414. For example, when upper and lower ends of the third support driver are rotatably assembled with the work platform 32 and the ceiling panel 3415 respectively, it is possible to prevent the third support driver from swinging.

As shown in FIG. 28, one third support driver 3414 may be arranged in the limiting inner cylinder 3419 and the limiting outer cylinder 3418. The top end of the third support driver 3414 may be hinged or pivotally assembled with a top of the limiting inner cylinder 3419, and a bottom end of the third support driver 3414 may be hinged or pivotally assembled with a bottom of the limiting outer cylinder 3418. The limiting inner cylinder 3419 and the limiting outer cylinder 3418 may protect the third support driver 3414.

In some embodiments, the stabilizing assembly 34 includes a third support assembly 343, and the third support assembly 343 includes a lateral panel 3431 and a fourth support driver 3432. The fourth support driver 3432 is arranged between the work platform 32 and the lateral panel 3431, and the fourth support driver 3432 is configured to drive the lateral panel 3431 to move, so that the lateral panel 3431 may support the lateral wall of the tunnel.

Figure 29:
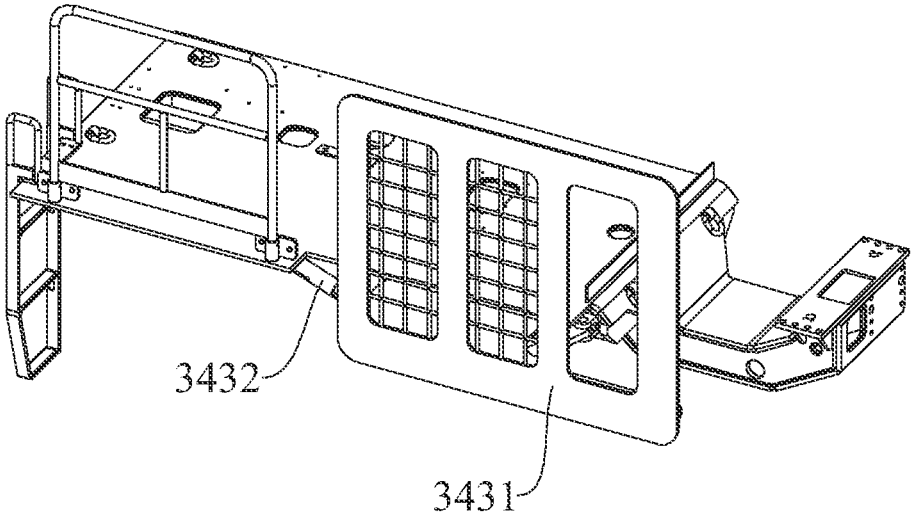
FIG. 29 is a schematic view of a third support assembly in FIG. 25.

Specifically, as shown in FIG. 25 and FIG. 29, the fourth support driver 3432 may be a hydraulic telescopic cylinder, an outer cylinder of the fourth support driver 3432 may be fixed with the work platform 32, the lateral panel 3431 may be fixed at a free end of the fourth support driver 3432, and the fourth support driver 3432 may extend along the left-right direction, so that the lateral panel 3431 may be driven to the left or to the right through the extension of the fourth support driver 3432, and thus the lateral panel 3431 may support the lateral wall of the tunnel. The arrangement of the third support assembly 343 enhances an action fulcrum and further enhances the stability during bolt support operations.

In some embodiments, the third support assembly 343 includes a first connection rod 3433 and a second connection rod 3434. One end of the first connection rod 3433 is rotatably connected with the work platform 32, and the other end of the first connection rod 3433 is rotatably connected with the lateral panel 3431. One end of the second connection rod 3434 is rotatably connected with the work platform 32, and the other end of the second connection rod 3434 is rotatably connected with the lateral panel 3431. The first connection rod 3433 and the second connection rod 3434 are arranged in parallel and at intervals along the length direction of the rack. One end of the fourth support driver 3432 is connected with the work platform 32, and the other end of the fourth support driver 3432 is connected with the first connection rod 3433 or the second connection rod 3434. The fourth support driver 3432 is configured to drive the first connection rod 3433 or the second connection rod 3434 to swing, so as to move the lateral panel 3431.

Figure 30:
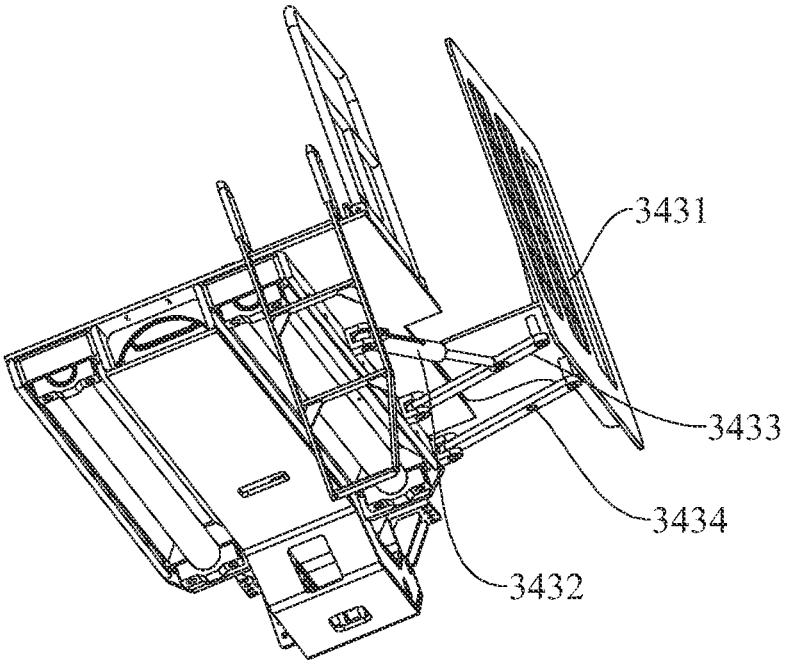
FIG. 30 is a bottom view of the third support assembly in FIG. 25.

Specifically, as shown in FIG. 26 and FIG. 30, the first connection rod 3433 and the second connection rod 3434 are parallel and equal. Both ends of the first connection rod 3433 are hinged with the lateral panel 3431 and the work platform 32, respectively. Both ends of the second connection rod 3434 are hinged with the lateral panel 3431 and the work platform 32, respectively. A four-linkage mechanism is formed between the first connection rod 3433, the second connection rod 3434, the work platform 32, and the lateral panel 3431. One end of the fourth support driver 3432 is hinged with the work platform 32, and the other end of the fourth support driver 3432 is hinged with the first connection rod 3433. The first connection rod 3433 may be driven to swing through the extension and retraction of the fourth support driver 3432, and hence the lateral panel 3431 may be driven to translate.

In some other embodiments, one end of the fourth support driver 3432 may be hinged with the work platform 32, and the other end of the fourth support driver 3432 may be hinged with the second connection rod 3434. The arrangement of the four-linkage mechanism ensures the translation of the lateral panel 3431, and avoids a situation that the mechanism is locked, which is conducive to the retraction and support of the lateral panel 3431.

In some embodiments, the work platform 32 includes a first platform 322, a second platform 321 and a platform driver 323. The second platform 321 is arranged on the lifting assembly 31, the first platform 322 is arranged on the second platform 321, and the first platform 322 is slidable relative to the second platform 321 in the length direction of the rack 1. One end of the platform driver 323 is connected with the first platform 322, and the other end of the platform driver 323 is connected with the second platform 321. The platform driver 323 is configured to drive the first platform 322 to move to realize the extension and retraction of the work platform 32. The first drilling frame assembly 33 and the stabilizing assembly 34 are arranged on the first platform 322.

Specifically, as shown in FIGS. 11-15, both the first platform 322 and the second platform 321 may be platforms having a rectangular parallelepiped shape, thus enhancing the guiding effect of the work platform 32. The second platform 321 may be fixed at a top end of the lifting assembly 31. The first platform 322 may be assembled with the second platform 321 in a guided manner, and the first platform 322 may slide relative to the second platform 321 in the front-rear direction. The platform driver 323 may be a telescopic hydraulic cylinder, a rear end of the platform driver 323 may be hinged with the second platform 321, and a front end of the platform driver 323 may be hinged with the first platform 322. The movement of the first platform 322 may be realized through the extension of the platform driver 323. The first drilling frame assembly 33 and the stabilizing assembly 34 may both be fixed at a front end of the first platform 322, and the movement of the positions of the first drilling frame assembly 33 and the stabilizing assembly 34 may be realized through the movement of the first platform 322.

In some embodiments, the first platform 322 and the second platform 321 are formed by tailor welding of steel plates.

In some embodiments, the first platform 322 includes a straight section 3222 and a bent section 3223, the straight section 3222 is assembled with the second platform 321 in a guided manner, and the bent section 3223 is connected with a free end of the straight section 3222. The bent section 3223 protrudes downwards and forms an avoidance groove thereabove. The first drilling frame assembly 33 includes the mounting seat 331 and the anchor drill, the mounting seat 331 is arranged at a free end of the bent section 3223, and the anchor drill is arranged on the mounting seat 331. The position of the anchor drill relative to the mounting seat 331 in the width direction of the rack 1 is adjustable. The avoidance groove is configured to avoid the anchor drill when the anchor drill moves along the width direction of the rack 1. The platform driver 323 is arranged below the work platform 32, and an end of the platform driver 323 is connected with the bent section 3223.

Figure 14:
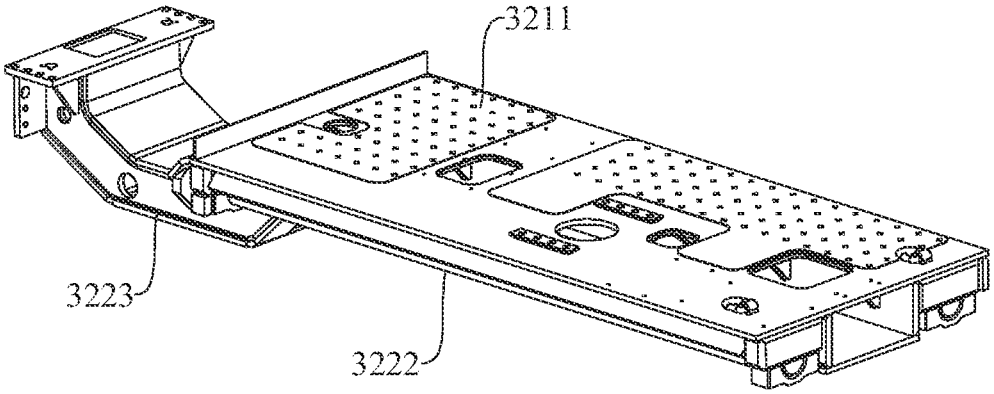
FIG. 14 is a schematic view of a work platform in FIG. 10.

Specifically, as shown in FIG. 14, the straight section 3222 is generally in a rectangular parallelepiped shape, and the bent section 3223 is generally C-shaped. The straight section 3222 is assembled with the second platform 321 in a guided manner, and the bent section 3223 is arranged at a front end of the straight section 3222. The mounting seat 331 of the first drilling frame assembly 33 may be mounted at a front end of the bent section 3223, and the anchor drill of the first drilling frame assembly 33 may be mounted on a rear side surface of the mounting seat 331. Consequently, the anchor drill will be fitted in the avoidance groove formed above the bent section 3223. When the anchor drill swings or moves in the left-right direction, the avoidance groove may provide sufficient operation space for the anchor drill. In addition, the arrangement of the bent section 3223 can enhance the structural strength of the first platform 322 on the one hand, and reduce the mounting height of the anchor drill on the other hand, which is conducive to improving the trafficability of the bolter miner 100.

In some embodiments, the bent section 3223 has a first inclined plane 3221, and the lifting assembly 31 has a second inclined plane 311. The first inclined plane 3221 is configured to fit and cooperate with the second inclined plane 311 to support and limit the work platform 32 when the work platform 32 is retracted to the shortest.

Figure 12:
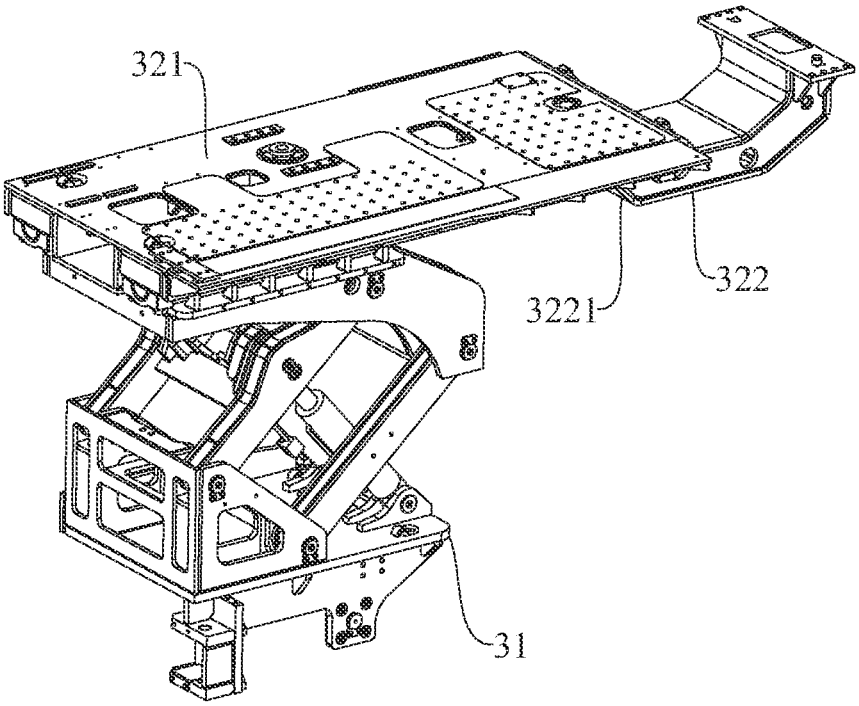
FIG. 12 is a schematic view of a work platform and a lifting assembly in FIG. 9.
Figure 13:
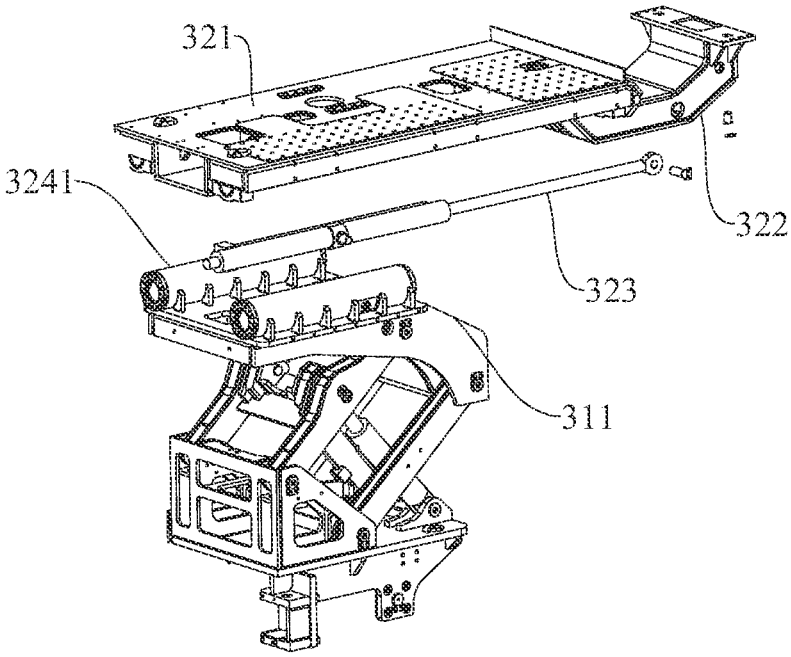
FIG. 13 is an exploded view of the work platform and the lifting assembly in FIG. 12.
Figure 23:
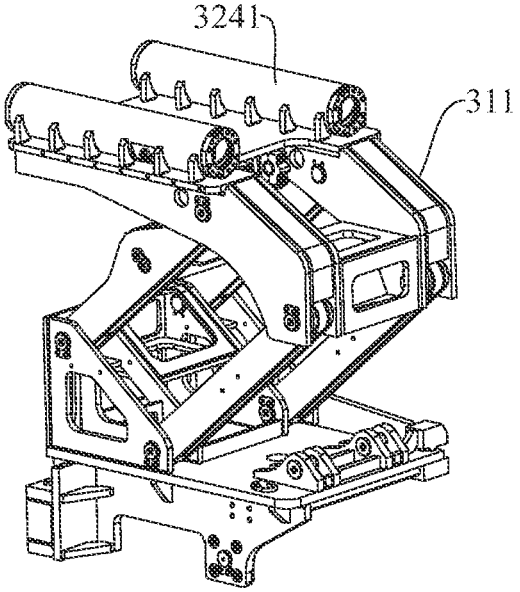
FIG. 23 is a perspective view of a lifting assembly in FIG. 10.

Specifically, as shown in FIG. 12, the first inclined plane 3221 is arranged on a rear side of the bent section 3223, and as shown in FIG. 13 and FIG. 23, the second inclined plane 311 is arranged on a front side of a top of the lifting assembly 31. Both the first inclined plane 3221 and the second inclined plane 311 are inclined downwards in a direction from the rear to the front, and inclination angles of the first inclined plane 3221 and the second inclined plane 311 are generally the same. Consequently, when the first platform 322 is retracted, the first inclined plane 3221 can be in contact with and fit with the second inclined plane 311, so as to support and limit the work platform 32, thus ensuring the compactness and stability of the structure.

In some embodiments, the work platform 32 includes a guide member 324, and the guide member 324 includes a guide outer cylinder 3241 and a guide inner cylinder 3242. The guide outer cylinder 3241 is connected with the second platform 321 or the lifting assembly 31, and the guide inner cylinder 3242 is fitted in the guide outer cylinder 3241 and is slidable along the length direction of the rack 1. The guide inner cylinder 3242 is connected with the first platform 322 and limits a direction of extension and retraction of the first platform 322. The guide outer cylinder 3241 has an oil injection hole, and the oil injection hole is configured to inject lubricating oil into the guide outer cylinder 3241 and the guide inner cylinder 3242.

Figure 11:
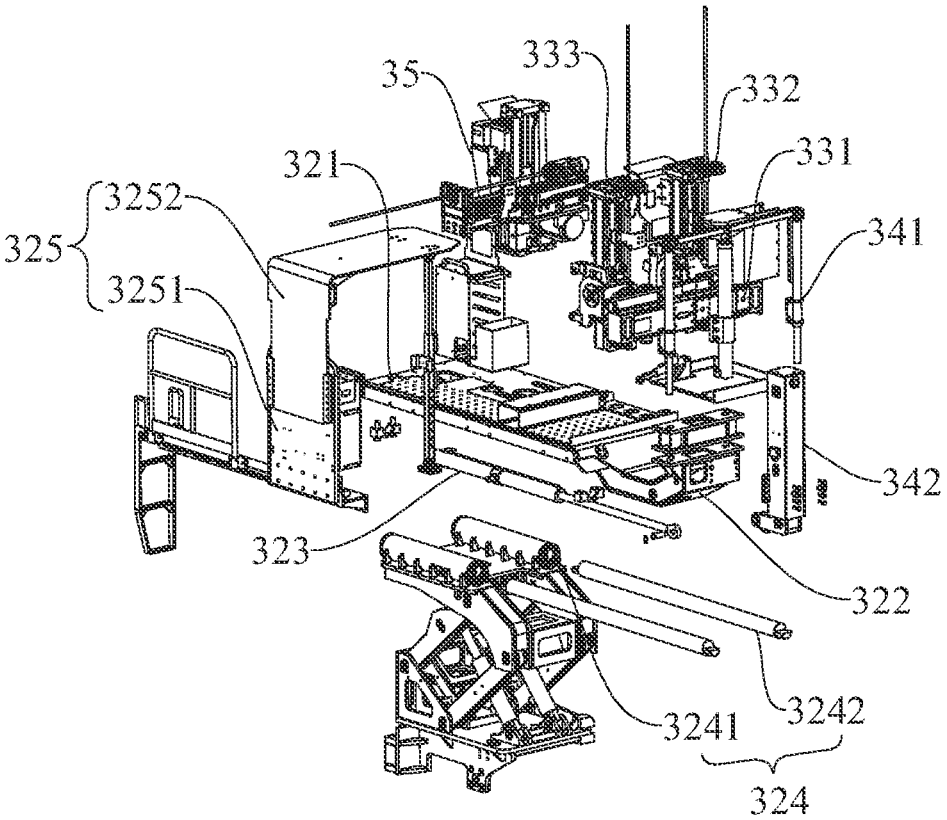
FIG. 11 is an exploded view of the single drilling device in FIG. 10.

Specifically, as shown in FIG. 11, the guide outer cylinder 3241 may be fixed at the top of the lifting assembly 31, and the guide inner cylinder 3242 is fitted in the guide outer cylinder 3241 in a guided manner and is slidable in the front-rear direction. A front end of the guide inner cylinder 3242 may be hinged with the first platform 322. The arrangement of the guide member 324 enhances the guiding effect and the structural strength and enables the work platform 32 to meet impact requirements during bolt support operations.

The guide outer cylinder 3241 may have an oil injection hole, and lubricating oil may be injected into the guide outer cylinder 3241 through the oil injection hole, so that the smooth sliding between the guide inner cylinder 3242 and the guide outer cylinder 3241 is ensured.

In some embodiments, a seal ring and a mud-scraping ring are provided at a port of the guide outer cylinder 3241, to prevent impurities from entering the guide outer cylinder 3241, thus further ensuring the smooth sliding of the guide inner cylinder 3242.

In some embodiments, the bolt support device 3 includes a second drilling frame assembly 35, and the second drilling frame assembly 35 is arranged on the second platform 321. The second drilling frame assembly 35 includes a lifting mechanism 351 and a third anchor drill 352. The lifting mechanism 351 is arranged on the second platform 321, and the third anchor drill 352 is arranged on the lifting mechanism 351 and is rotatable in the width direction of the rack 1. The lifting mechanism 351 is configured to lift the third anchor drill 352.

Figure 24:
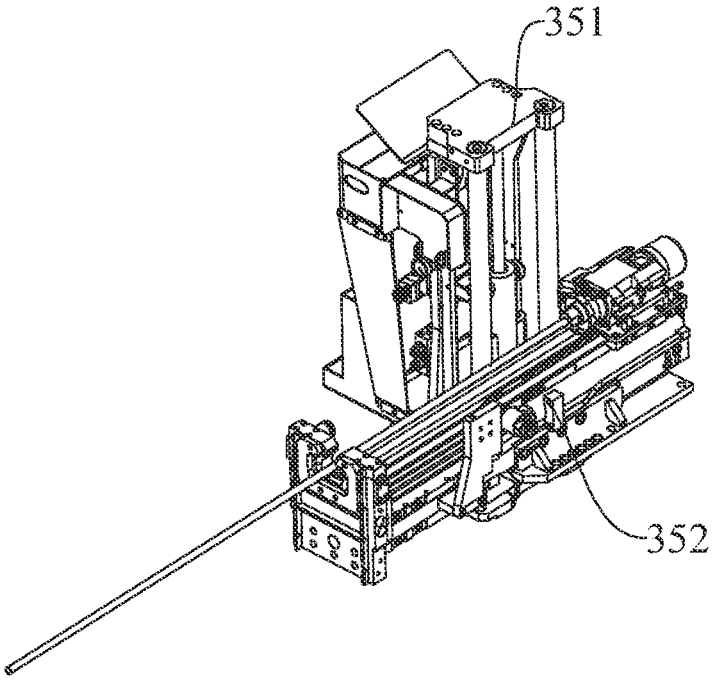
FIG. 24 is a schematic view of a second drilling frame assembly in FIG. 5.

Specifically, as shown in FIG. 24, the lifting mechanism 351 may include a lifting frame and a lifting oil cylinder. The lifting frame includes a guide rod, and a sliding plate is assembled on the guide rod in a guided manner. One end of the lifting oil cylinder is connected with a top end of the lifting frame, and a bottom end of the lifting oil cylinder is connected with the sliding plate. The third anchor drill 352 may be connected with the sliding plate through swing drive. The third anchor drill 352 is mainly used for bolt support for the lateral wall of the tunnel.

During use, the sliding plate may be driven to move upwards by the lifting oil cylinder, so that the third anchor drill 352 may be moved in the up-down direction. The third anchor drill 352 may be driven to swing in the left-right direction by the swing drive between the sliding plate and the third anchor drill 35, so that the installation orientation of the anchor rod may be adjusted.

It should be noted that, during use, the spacing between the first drilling frame assembly 33 and the second drilling frame assembly 35 may be adjusted by adjusting the work platform 32 to different extension and retraction amounts, thus meeting the adaptability to different bolt support row spacing.

In some embodiments, the work platform 32 includes a protective plate 325, and the protective plate 325 is arranged on the second platform 321 and located between the first drilling frame assembly 33 and the second drilling frame assembly 35. The protective plate 325 includes a first plate 3251 and a second plate 3252. The first plate 3251 is arranged on the second platform 321, and the second plate 3252 is arranged on the first plate 3251 and has a position adjustable in the un-down direction. The second plate 3252 includes a transverse section, and the transverse section extends along the width direction of the rack 1. The transverse section is configured to shelter the operators below.

Specifically, as shown in FIG. 11, the first plate 3251 may be fixedly connected with the second platform 321, and the first plate 3251 may be fixed at a side position of the second platform 321 and extend upwards. The second plate 3252 is an L-shaped plate, and the second plate 3252 may be assembled on the first plate 3251 in a guided manner, thus meeting operation requirements of operators of different heights and operation requirements of different tunnel heights. The transverse section is a part of the second plate 3252 that extends in the left-right direction. Consequently, the operators can operate inside the protective plate 325, avoiding a risk of being injured by falling coal rock.

The protective plate 325 is arranged between the first drilling frame assembly 33 and the second drilling frame assembly 35, so that the operators can operate the first drilling frame assembly 33 and the second drilling frame assembly 35 simultaneously, and thus the first drilling frame assembly 33 and the second drilling frame assembly 35 may share the protective plate 325.

Figure 15:
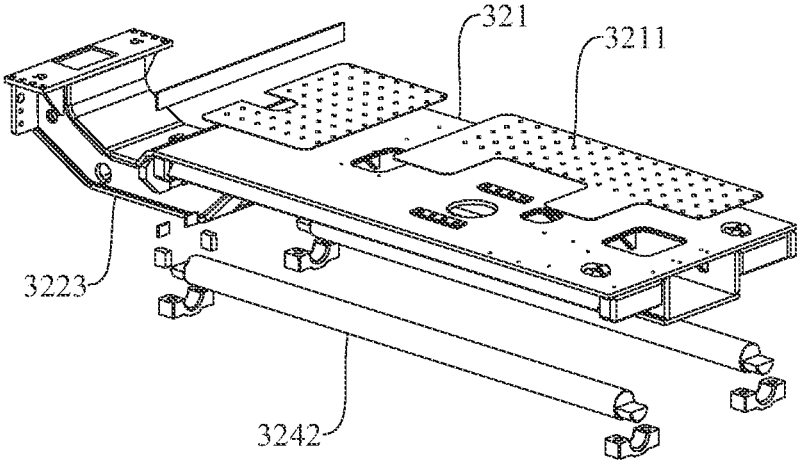
FIG. 15 is an exploded view of the work platform in FIG. 14.

In some embodiments, as shown in FIG. 14 and FIG. 15, the second platform 321 may be provided with an anti-slip plate 3211, so as to prevent the operators from slipping.

In some embodiments, the lifting assembly 31 is a scissor type lifting assembly 31, and the work platform 32 is arranged above the lifting assembly 31. The lifting assembly 31 is configured to vertically lift the work platform 32. As shown in FIG. 23, the scissor type lifting assembly 31 has a simple structure and is stable and reliable, which can fully meet the operation requirements in harsh underground conditions.

In some embodiments, the bolt support device 3 has a bolt support position, and when the bolt support device 3 is switched to the bolt support position, the operations of the bolter miner 100 may include the following steps.

At step S1, the cutting device 2 is controlled to swing downwards, and the cutting drum 21 of the cutting device 2 is in contact with the ground. Consequently, a situation that the cutting device 2 is suspended during the bolt support operation is avoided, and the stability of the bolt support operation is ensured.

At step S2, the lifting assembly 31 is lifted until the work platform 32 is higher than the cutting drum 21. Consequently, the interference between the work platform 32 and the cutting drum 21 is avoided, and the extension of the work platform 32 is facilitated.

At step S3, the work platform 32 extends, and the stabilizing assembly 34 on the work platform 32 moves to be above the cutting drum 21.

At step S4, the stabilizing assembly 34 extends, the top end of the stabilizing assembly 34 is pressed against and in contact with the tunnel roof, and the bottom end of the stabilizing assembly 34 is pressed against and in contact with the cutting drum 21.

At step S5, the first drilling frame assembly 33 is controlled to complete the bolt support operation.

In some embodiments, the bolt support device 3 has an avoidance position, and when the bolt support device 3 is switched to the avoidance position, the operations of the bolter miner may include the following steps.

At step S1, the first drilling frame assembly 33 is reset, and the anchor drill of the first drilling frame assembly 33 extends along the height direction of the rack. Consequently, an occupation size of the first drilling frame assembly 33 in the width direction of the rack is reduced, and the telescopic movement of the work platform 32 is facilitated.

At step S2, the stabilizing assembly 34 is controlled to retract, and the stabilizing assembly 34 is retracted to the shortest size. Consequently, the collision between the stabilizing assembly 34 and the cutting device 2 is avoided.

At step S3, the work platform 32 is retracted until the free end of the work platform 32 is moved to be behind the cutting drum 21 of the cutting device 2.

At step S4, the lifting assembly 31 is lowered until it reaches the lowest height. Consequently, the bolt support device 3 has a compact structure, avoiding contact with the cutting device 2 during a cutting operation.

At step S5, the cutting device 2 is controlled to swing upwards and complete the cutting operation.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure. In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature. Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Moreover, those skilled in the art can integrate and combine the different embodiments or examples and the features of the different embodiments or examples described in this specification without contradicting each other.

Although embodiments of the present disclosure have been shown and described, it can be appreciated by those skilled in the art that the above embodiments are merely exemplary and are not intended to limit the present disclosure, and various changes, modifications, alternatives and variations may be made in the embodiments within the scope of the present disclosure.

The invention claimed is:

1. A tunneling system, comprising:

a bolter miner comprising a rack, a cutting device, and a bolt support device, wherein the cutting device is arranged on the rack and swingable in an up-down direction, the bolt support device comprises a lifting assembly, a work platform, a first drilling frame assembly and a stabilizing assembly, the lifting assembly is arranged between the rack and the work platform, the lifting assembly is configured to lift the work platform, the first drilling frame assembly and the stabilizing assembly are arranged on the work platform, the work platform is retractable to allow the first drilling frame assembly to move to be above the cutting device, the first drilling frame assembly is configured to perform a bolt support operation, and the stabilizing assembly is configured to be supported between the cutting device and a tunnel roof to enhance the stability of the first drilling frame assembly during the bolt support operation;

a bolter-integrated transportation machine arranged behind the bolter miner and configured to transfer coal rock cut and conveyed by the bolter miner;

a transfer machine and a self-moving tail, wherein one end of the transfer machine is connected with the bolter-integrated transportation machine and is configured to move synchronously with the bolter-integrated transportation machine, the transfer machine is bendable, the transfer machine is arranged behind the bolter-integrated transportation machine, the transfer machine is configured to transfer the coal rock conveyed by the bolter-integrated transportation machine, the other end of the transfer machine is lapped with the self-moving tail, and the self-moving tail is configured to transfer the coal rock conveyed by the transfer machine; and a belt conveyor arranged behind the self-moving tail, and configured to transfer the coal rock conveyed by the self-moving tail.

2. The tunneling system according to claim 1, wherein the self-moving tail comprises a self-moving bracket and a driving device, the self-moving bracket is arranged at a front end of the self-moving tail, the driving device is arranged at a rear end of the self-moving tail, the self-moving tail is configured to walk to drive the self-moving tail to move forwards, and the driving device is configured to drive the self-moving tail to move backwards.

3. The tunneling system according to claim 1, wherein the bolter-integrated transportation machine comprises a crushing device, and the crushing device is configured to crush the coal rock to facilitate transfer and transportation of the coal rock.

4. The tunneling system according to claim 1, wherein the bolt support device comprises a first bolt support device and a second bolt support device, the first bolt support device and the second bolt support device are arranged at intervals along a width direction of the rack, the first bolt support device is configured to perform the bolt support operation on a side of a tunnel, the second bolt support device is configured to perform the bolt support operation on another side of the tunnel, and the first bolt support device and the second bolt support device are configured to perform staggered bolt support operations in a length direction of the rack.

5. The tunneling system according to claim 1, wherein the first drilling frame assembly comprises a mounting seat and an anchor drill, the mounting seat is arranged on the work platform, the anchor drill is arranged on the mounting seat, a position of the anchor drill relative to the mounting seat in a width direction of the rack is adjustable, and the anchor drill is rotatable relative to the mounting seat.

6. The tunneling system according to claim 5, wherein the mounting seat comprises a first seat and a second seat, the first seat and the second seat extend along the width direction of the rack, the first seat is arranged on the rack, the second seat is arranged on the first seat, a position of the second seat relative to the first seat in the width direction of the rack is adjustable, the anchor drill comprises a first anchor drill and a second anchor drill, the first anchor drill and the second anchor drill are arranged on the second seat, and a position of at least one of the first anchor drill and the second anchor drill relative to the second seat in the width direction of the rack is adjustable.

7. The tunneling system according to claim 6, wherein in the width direction of the rack, the first anchor drill is located on an outer side of the second anchor drill, the second anchor drill is arranged on the second seat and is rotatable in at least one of a length direction and the width direction of the rack, the first anchor drill is arranged on the second seat and has a position adjustable relative to the second seat in the width direction of the rack, and the first anchor drill is rotatable in at least one of the length direction and the width direction of the rack.

8. The tunneling system according to claim 6, wherein in the length direction of the rack, the stabilizing assembly is located on an outer side of the first drilling frame assembly, a first blocking member is connected between the second seat and the stabilizing assembly, and the first blocking member is configured to unfold to block the coal rock when the second seat moves.

9. The tunneling system according to claim 1, wherein the stabilizing assembly comprises a first support assembly and a second support assembly, the first support assembly and the second support assembly are arranged on the work platform, the first support assembly is configured to extend upwards and support the tunnel roof, and the second support assembly is configured to extend downwards and support the cutting device.

10. The tunneling system according to claim 9, wherein the first support assembly comprises a first support driver, a crossbar and a second blocking member, the first support driver is connected with the work platform, a free end of the first support driver is configured to support the tunnel roof, the crossbar is connected with the free end of the first support driver, the second blocking member is connected between the crossbar and the work platform, and the second blocking member is configured to unfold to block the coal rock when the first support driver provides support.

11. The tunneling system according to claim 9, wherein the second support assembly comprises a support inner cylinder, a support outer cylinder and a second support driver, the support outer cylinder is arranged on the work platform, the support inner cylinder is fitted in the support outer cylinder and is slidable relative to the support outer cylinder, the second support driver is arranged in the support outer cylinder, one end of the second support driver is connected with the support outer cylinder, the other end of the second support driver is connected with the support inner cylinder, and the second support driver is configured to drive the support inner cylinder to move, to allow the second support assembly to support the cutting device.

12. The tunneling system according to claim 11, wherein the second support assembly comprises a pressure block, the pressure block is rotatably connected with a free end of the support inner cylinder, the pressure block has a fitting surface, the pressure block is configured to rotate when the second support assembly supports the cutting device, to allow the fitting surface to fit with the cutting device, the cutting device comprises a support part, and the support part extends along a length direction of the rack, to meet the support for the pressure block after the work platform is adjusted to different extension and retraction amounts.

13. The tunneling system according to claim 11, wherein the support inner cylinder comprises an inner cylinder section and an extension section, the inner cylinder section is fitted in the support outer cylinder in a guided manner, the extension section is arranged at a free end of the inner cylinder section and is at an included angle with the inner cylinder section, the extension section extends towards a side of the rack, and the pressure block is rotatably connected with a free end of the extension section.

14. The tunneling system according to claim 9, wherein the first support assembly comprises a plurality of third support drivers and a ceiling panel, the plurality of third support drivers are arranged in parallel and at intervals, one end of the third support driver is connected with the work platform, the other end of the third support driver is rotatably connected with the ceiling panel, the ceiling panel is configured to support the tunnel roof through the extension of the plurality of third support drivers, and the ceiling panel is configured to achieve inclination adjustment by adjusting the plurality of third support drivers to different extension and retraction amounts.

15. The tunneling system according to claim 14, wherein the ceiling panel comprises a main ceiling, an inner ceiling and an outer ceiling, the plurality of third support drivers are connected with the main ceiling, the inner ceiling is rotatably connected with the main ceiling and is located on an inner side of the main ceiling, a first ceiling driver is arranged between the inner ceiling and the main ceiling, the first ceiling driver is configured to obliquely support the inner ceiling, to allow the inner ceiling to swing up and down, the outer ceiling is rotatably connected with the main ceiling and is located on an outer side of the main ceiling, a second ceiling driver is arranged between the outer ceiling and the main ceiling, and the second ceiling driver is configured to obliquely support the outer ceiling, to allow the outer ceiling to swing up and down.

16. The tunneling system according to claim 14, wherein the first support assembly comprises a limiting outer cylinder and a limiting inner cylinder, the limiting outer cylinder is connected with the work platform, the limiting inner cylinder is slidably fitted in the limiting outer cylinder in a guided manner and is connected with the ceiling panel, and the limiting outer cylinder and the limiting inner cylinder cover an outer side of the third support driver to limit a direction of extension and retraction of the third support driver when the third support driver extends and retracts.

17. The tunneling system according to claim 9, wherein the stabilizing assembly comprises a third support assembly, the third support assembly comprises a lateral panel and a fourth support driver, the fourth support driver is arranged between the work platform and the lateral panel, and the fourth support driver is configured to drive the lateral panel to move, to allow the lateral panel to support a lateral wall of a tunnel.

18. The tunneling system according to claim 17, wherein the third support assembly comprises a first connection rod and a second connection rod, one end of the first connection rod is rotatably connected with the work platform, the other end of the first connection rod is rotatably connected with the lateral panel, one end of the second connection rod is rotatably connected with the work platform, the other end of the second connection rod is rotatably connected with the lateral panel, the first connection rod and the second connection rod are arranged in parallel and at intervals along a length direction of the rack, one end of the fourth support driver is connected with the work platform, the other end of the fourth support driver is connected with the first connection rod or the second connection rod, and the fourth support driver is configured to drive the first connection rod or the second connection rod to swing, to move the lateral panel.

19. The tunneling system according to claim 1, wherein the work platform comprises a first platform, a second platform and a platform driver, the second platform is arranged on the lifting assembly, the first platform is arranged on the second platform, the first platform is slidable relative to the second platform in a length direction of the rack, one end of the platform driver is connected with the first platform, the other end of the platform driver is connected with the second platform, the platform driver is configured to drive the first platform to move, to allow the work platform to extend and retract, and the first drilling frame assembly and the stabilizing assembly are arranged on the first platform.

20. The tunneling system according to claim 19, wherein the first platform comprises a straight section and a bent section, the straight section is assembled with the second platform in a guided manner, the bent section is connected with a free end of the straight section, the bent section protrudes downwards and forms an avoidance groove thereabove, the first drilling frame assembly comprises a mounting seat and an anchor drill, the mounting seat is arranged at a free end of the bent section, the anchor drill is arranged on the mounting seat, a position of the anchor drill relative to the mounting seat in a width direction of the rack is adjustable, the avoidance groove is configured to avoid the anchor drill when the anchor drill moves along the width direction of the rack, the platform driver is arranged below the work platform, an end of the platform driver is connected with the bent section, the bent section comprises a first inclined plane, the lifting assembly comprises a second inclined plane, and the first inclined plane is configured to fit and cooperate with the second inclined plane to support and limit the work platform when the work platform is retracted to the shortest.

* * * * *